US009593872B2

(12) United States Patent
Takenaka et al.

(10) Patent No.: US 9,593,872 B2
(45) Date of Patent: Mar. 14, 2017

(54) HEAT PUMP

(75) Inventors: Naofumi Takenaka, Chiyoda-ku (JP); Shinichi Wakamoto, Chiyoda-ku (JP); Koji Yamashita, Chiyoda-ku (JP); Hiroyuki Morimoto, Chiyoda-ku (JP); Takeshi Hatomura, Chiyoda-ku (JP); Yusuke Shimazu, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 462 days.

(21) Appl. No.: 13/503,483

(22) PCT Filed: Oct. 27, 2009

(86) PCT No.: PCT/JP2009/068358
§ 371 (c)(1),
(2), (4) Date: Apr. 23, 2012

(87) PCT Pub. No.: WO2011/052031
PCT Pub. Date: May 5, 2011

(65) Prior Publication Data
US 2012/0204596 A1 Aug. 16, 2012

(51) Int. Cl.
*F25B 30/02* (2006.01)
*F25B 6/04* (2006.01)
(Continued)

(52) U.S. Cl.
CPC ..... *F25B 30/02* (2013.01); *F25B 6/04* (2013.01); *F25B 13/00* (2013.01); *F25B 7/00* (2013.01);
(Continued)

(58) Field of Classification Search
CPC ..... F25B 40/02; F25B 40/04; F25B 2400/13; F25B 25/005; F25B 7/00; F25B 6/04;
(Continued)

(56) References Cited

U.S. PATENT DOCUMENTS 3,852,974 A * 12/1974 Brown ..... 62/335
7,464,563 B2 * 12/2008 Park et al. ..... 62/335
(Continued)

FOREIGN PATENT DOCUMENTS

CN 1886625 A 12/2006
JP 2 290475 11/1990
(Continued)

OTHER PUBLICATIONS

The Engineering Tool Box Refrigerant Properties Page, <http://www.engineeringtoolbox.com/refrigerants-properties-d_145.html>, Feb. 28, 2006. (Retrieved by the Internet Archive Wayback machine).*
(Continued)

*Primary Examiner* — Len Tran
*Assistant Examiner* — Hans Weiland
(74) *Attorney, Agent, or Firm* — Oblon, McClelland, Maier & Neustadt, L.L.P.

(57) ABSTRACT

A heat pump capable of operating in a high COP state even if influx temperature of a medium to be heated flowing into the radiators has increased. The heat pump includes a compressor, a first radiator, a second radiator, an expansion valve, and an evaporator sequentially connected by refrigerant piping to form a first refrigeration cycle, in which a first refrigerant circulates in the first refrigeration cycle, and in which the first radiator and the second radiator are serially connected. A first heat exchange unit that heats the first refrigerant is provided in a refrigerant piping at a refrigerant inlet side of the second radiator, and a second heat exchange unit that cools the first refrigerant is provided in a refrigerant piping at a refrigerant outlet side of the second radiator.

7 Claims, 13 Drawing Sheets

(51) Int. Cl.
*F25B 25/00* (2006.01)
*F25B 13/00* (2006.01)
*F25B 7/00* (2006.01)

(52) U.S. Cl.
CPC ..... *F25B 25/005* (2013.01); *F25B 2313/0233* (2013.01); *F25B 2339/047* (2013.01); *F25B 2400/05* (2013.01)

(58) Field of Classification Search
CPC ..... F25B 13/04; F25B 30/02; F25B 2400/05; F25B 2313/0233; F25B 2339/047
USPC ..... 62/324.3, 333, 335, 510, 513
See application file for complete search history.

(56) References Cited

U.S. PATENT DOCUMENTS

| | | | | |
|---|---|---|---|---|
| 2007/0271936 | A1* | 11/2007 | Wakamoto et al. | 62/160 |
| 2008/0236185 | A1* | 10/2008 | Choi et al. | F25B 13/00 62/332 |

FOREIGN PATENT DOCUMENTS

| | | |
|---|---|---|
| JP | 2001-41601 | 2/2001 |
| JP | 2004 3801 | 1/2004 |
| JP | 2005 90825 | 4/2005 |
| JP | 2005-114253 | 4/2005 |
| JP | 2007 3169 | 1/2007 |
| JP | 2007-85647 | 4/2007 |
| JP | 2008 2759 | 1/2008 |
| JP | 2008-267731 | 11/2008 |
| WO | 2005 052467 | 6/2005 |

OTHER PUBLICATIONS

Machine Translation of JP 2005090825 A—retreived on Mar. 31, 2014.*
International Search Report Issued Dec. 8, 2009 in PCT/JP09/68358 Filed Oct. 27, 2009.
Notice of Reasons for Rejection issued May 14, 2013 in Japanese Patent Application No. 2011-538132 (with English translation).
Combined Office Action and Search Report issued Dec. 4, 2013 in Chinese Patent Application No. 200980162230.5 (with English abstract and English translation of Category of Cited Documents).
Extended European Search Report issued Sep. 13, 2016 in Patent Application No. 09850811.2.

* cited by examiner

HEAT PUMP

TECHNICAL FIELD

The present invention relates to a heat pump including a compressor, a plurality of radiators, an expansion valve, and an evaporator.

BACKGROUND ART

Conventionally, a heat pump including a compressor, a plurality of radiators, an expansion valve and an evaporator has been proposed (for example, refer to Patent Literature 1 and Patent Literature 2).

For example, in Patent Literature 1, a heat pump including a primary-side refrigerant circuit in which a compressor, a plurality of gas coolers, an expansion valve, and an evaporator are connected by refrigerant piping, and a secondary-side refrigerant circuit in which a gas cooler and a circulation pump are connected by piping is proposed. In this heat pump, water flowing through the secondary-side refrigerant circuit is heated in the gas cooler, and the heated water is used in hot water supply, cooling and heating, floor heating, and the like.

In Patent Literature 1, a method for connecting (serial connection and parallel connection) the gas coolers in accordance with the influx temperature of water flowing into the gas coolers is proposed. The gas coolers are disposed based on a connection method in accordance with the influx temperature of water flowing into the gas coolers, and COP is improved by utilizing the heat energy of a refrigerant flowing through the gas coolers in a cascaded manner.

For example, in Patent Literature 2, a heat pump that performs refrigeration and freezing in which a high order-side refrigeration system, which assists the heat transfer of a low order-side refrigeration system, is connected to a radiator outlet of the low order-side refrigeration system is proposed. In this heat pump, in a cooling operation such as refrigeration or freezing, refrigerant in an outlet of an outdoor heat exchanger is cooled using the high order-side refrigeration system in order to improve the refrigeration capacity.

CITATION LIST

Patent Literature

Patent Literature 1: Japanese Unexamined Patent Application Publication No. 2004-003801 (pp. 16 to 20, and FIGS. 4 to 8)

Patent Literature 2: Japanese Unexamined Patent Application Publication No. 2008-002759 (pp. 7 to 9, and FIG. 1)

SUMMARY OF INVENTION

Technical Problem

However, in the conventional heat pumps, there has been a problem in that, if the temperature of a medium to be heated (air, water, brine, etc.) flowing into the radiator is high during hot water supply or heating operation, the heating/hot water capacity decreases.

For example, in the heat pump disclosed in Patent Literature 1, the temperature of the water flowing into the gas coolers is estimated in advance, and the gas coolers are arranged based on this temperature. Therefore, if the temperature of the water flowing into the gas coolers rises above the estimated value, COP decreases.

The heat pump disclosed in Patent Literature 2 is intended to improve the refrigeration capacity.

The present invention has been made to overcome the above-described problems, and an object of the invention is to provide a heat pump capable of operating in a high COP state even if the influx temperature of a medium to be heated, which is used in heating or hot water supply or the like, flowing into the radiators has risen.

Solution to Problem

A heat pump according to the invention includes a first compressor, a plurality of radiators, a first pressure reducing device, and an evaporator being connected by refrigerant piping to form a first refrigeration cycle in which a first refrigerant circulates. The radiators are serially connected and when viewed along a direction of flow of the first refrigerant, a first heat exchange unit that heats the first refrigerant is provided in a refrigerant piping on a refrigerant inlet side of at least one of the second and subsequent radiators and a second heat exchange unit that cools the first refrigerant is provided in a refrigerant piping on a refrigerant outlet side of a radiator that is disposed at the most upstream position among the radiator(s) that is provided with a first heat exchange unit, or of a radiator that is further downstream of the radiator that is provided with a first heat exchange unit and that is disposed at the most upstream position.

Advantageous Effects of Invention

In the invention, a first heat exchange unit that heats the first refrigerant is provided in a refrigerant piping on a refrigerant inlet side of at least one of the second and subsequent radiators when viewed along a direction of flow of the first refrigerant. Therefore, even if the influx temperature of a medium to be heated, which is used in heating or hot water supply or the like, flowing into the radiators has increased, a temperature difference between the medium to be heated and the first refrigerant can be maintained in the second and subsequent radiators. Further, a second heat exchange unit that cools the first refrigerant is provided in a refrigerant piping on a refrigerant outlet side of a radiator that is disposed at the most upstream position among the radiator(s) that is provided with a first heat exchange unit, or of a radiator that is further downstream of the radiator that is provided with a first heat exchange unit and that is disposed at the most upstream position. Therefore, an enthalpy difference of the first refrigerant flowing through the evaporator can be increased. Thus, the heat collecting capacity of the evaporator can be improved, and the efficiency (heating capacity) of the heat pump can be improved.

Accordingly, a heat pump can be obtained that is capable of operating in a high COP state even if the temperature of the medium to be heated, which is used in heating or hot water supply or the like, flowing into the radiator has increased.

DESCRIPTION OF EMBODIMENTS

Embodiment of the present invention will be described below with reference to the drawings.

Embodiment 1

Figure 1:
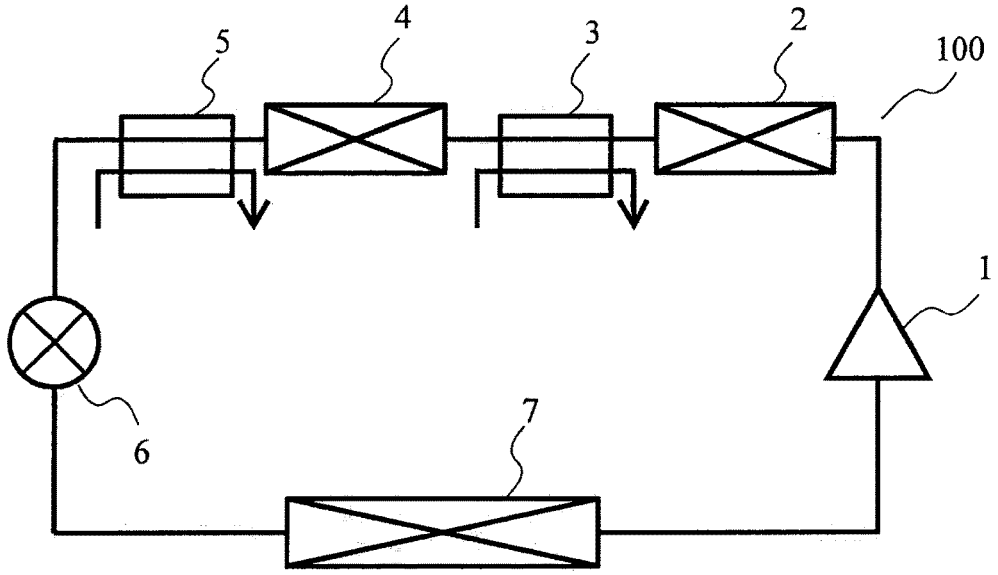
FIG. 1 is a refrigerant circuit diagram showing an example of the heat pump according to Embodiment 1.

FIG. 1 is a refrigerant circuit diagram showing an example of the heat pump according to Embodiment 1. A "heat pump" refers to a refrigeration device that performs hot water supply and air conditioning.

In a heat pump 100, a first compressor 1, a first radiator 2, a second radiator 4, an expansion valve 6, and an evaporator 7 are connected by refrigerant piping to form a primary-side refrigeration cycle. The heat pump 100 is used for, for example, heating, and air (the first radiator 2 and the second radiator 4) supplied by a fan or the like (not illustrated) is heated by a primary-side refrigerant that flows through the first radiator 2 and the second radiator 4. In Embodiment 1, as the primary-side refrigerant, a refrigerant (for example, carbon dioxide) that operates in a supercritical state in the course of radiation is used.

The expansion valve 6 corresponds to a first pressure reducing device of the invention, and the primary-side refrigeration cycle corresponds to a first refrigeration cycle of the invention. The primary-side refrigerant corresponds to a first refrigerant of the invention. The first pressure reducing device is not limited to the expansion valve 6, and various devices can be used. For example, a capillary or the like can be used as the first pressure reducing device.

In the primary-side refrigeration cycle, a first heat exchange unit 3 is provided in an upstream piping of the second radiator 4. The first heat exchange unit 3 heats the primary-side refrigerant flowing through the primary-side refrigeration cycle.

Also, in the primary-side refrigeration cycle, a second heat exchange unit 5 is provided in a downstream piping of the second radiator 4. The second heat exchange unit 5 cools the primary-side refrigerant flowing through the primary-side refrigeration cycle.

Although FIG. 1 describes an example using two radiators (the first radiator 2 and the second radiator 4), any number of radiators can be provided as long as a plurality (two or more) of radiators are serially connected. In this case, a first heat exchange unit 3 may be provided in an upstream piping (refrigerant inlet-side piping) of at least one radiator among the second and subsequent radiators along a direction of flow of the primary-side refrigerant. Further, the second radiator 4 may be provided in a downstream piping (refrigerant outlet-side piping) of a radiator that is provided with a first heat exchange unit and that is disposed at the most upstream position among the radiator(s) that is provided with a first heat exchange unit 3, or of a radiator that is further downstream of the radiator that is provided with a first heat exchange unit 3 and that is disposed at the most upstream position. The second heat exchange unit 5 should ideally be provided in a downstream piping of a radiator disposed at the most downstream position, because there are cases in which the primary-side refrigerant that has flowed out of an intermediate radiator need to be cooled in the second heat exchange unit 5 when, for example, there is a spaced interval between the radiators or the like.

The plurality of radiators are not limited to an air heat exchanger that exchanges heat with air, and a water heat exchanger that exchanges heat with water or brine or the like (hereinafter, when it is not particularly necessary to make a distinction between water or brine or the like, the term "water" alone will be used) may be used. Both air heat exchangers and water heat exchangers may of course be provided in the primary-side refrigeration cycle.

Figure 2:
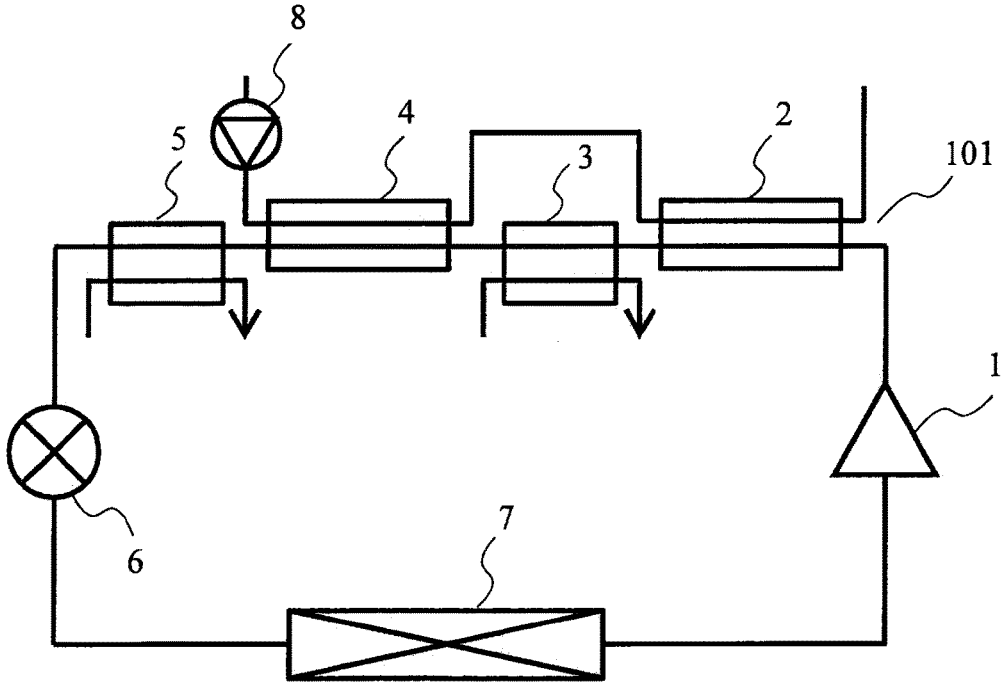
FIG. 2 is a refrigerant circuit diagram showing another example of the heat pump according to Embodiment 1.

For example, when water heat exchangers are used as the first radiator 2 and the second radiator 4, the constitution would be as shown in FIG. 2.

FIG. 2 is a refrigerant circuit diagram showing another example of the heat pump according to Embodiment 1. Water is serially supplied to the first radiator 2 and the second radiator 4 through a pump 8. In the first radiator 2 and the second radiator 4, the flow direction of the primary-side refrigerant and the flow direction of the water counter each other. By making the flow direction of the primary-side refrigerant and the flow direction of the water counter each other, a temperature difference between the primary-side refrigerant and the water can be easily obtained, and the heat exchange efficiency can be improved.

The water heated in the first radiator 2 and the second radiator 4 is used for, for example, hot water supply. Further, for example, the water heated in the first radiator 2 and the second radiator 4 flows into an indoor unit, a panel heater, a radiator, or the like connected to a water circuit to be used for heating and floor heating.

As the first radiator 2 and the second radiator 4 (water heat exchangers), a water plate heat exchanger, a water double pipe heat exchanger, a microchannel water heat exchanger, and the like may be used.

Figure 3:
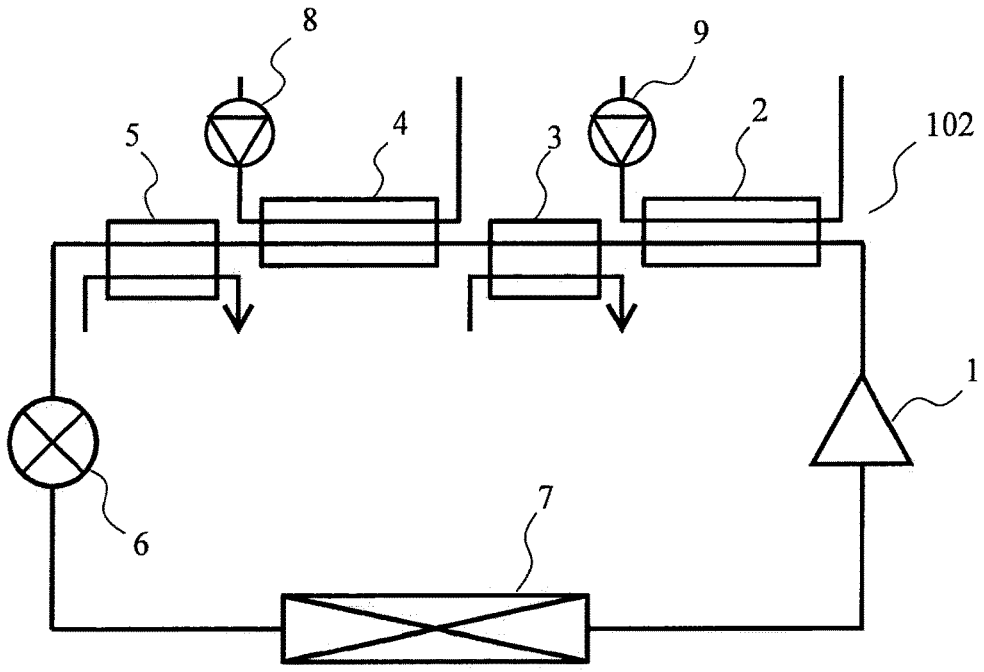
FIG. 3 is a refrigerant circuit diagram showing a further example of the heat pump according to Embodiment 1.

FIG. 3 is a refrigerant circuit diagram showing a further example of the heat pump according to Embodiment 1. Water used for water supply, heating, and the like is separately supplied to each of the first radiator 2 and the second radiator 4. In more detail, water is supplied to the first radiator 2 via a pump 9, and water is supplied to the second radiator 4 via a pump 8. Water can be serially supplied in this way to the first radiator 2 and the second radiator 4.

(Description of Operation)

Next, the operation of the heat pumps 100 to 102 will be described.

The first compressor 1 sucks in refrigerant evaporated in the evaporator 7 via an accumulator (not illustrated). During normal operation, the first compressor 1 compresses the primary-side refrigerant to its critical pressure or higher. Note that the accumulator does not have to be provided.

The primary-side refrigerant compressed in the first compressor 1 flows into the first radiator 2 and exchanges heat with air or water that is supplied (made to flow in) by a fan (not illustrated) or a pump (pump 8, 9), and is thereby cooled. The primary-side refrigerant that has been cooled in the first radiator 2 flows into the first heat exchange unit 3 and exchanges heat with a fluid with a higher temperature than that of the primary-side refrigerant, and is thereby heated. The primary-side refrigerant that has been heated in the first heat exchange unit 3 flows into the second radiator 4, and exchanges heat with air or water that is supplied by a fan or a pump (pump 8), and is thereby cooled. The primary-side refrigerant that has been cooled in the second radiator 4 then flows into the second heat exchange unit 5 and exchanges heat with a fluid of a lower temperature than that of the primary-side refrigerant, and is thereby further cooled. The refrigerant that has flowed out from the second heat exchange unit 5 is decompressed in the expansion valve 6 to become a low-temperature low-pressure two-phase gas-liquid refrigerant. This primary-side refrigerant flows into the evaporator 7 and exchanges heat with air or water (receives heat from air or water) that flows into the evaporator. The primary-side refrigerant that has flowed out of the evaporator 7 is sucked into the compressor via the accumulator (not illustrated).

In the heat pumps 100 to 102 constituted as above, the primary-side refrigerant that has been cooled in the first radiator 2 is heated in the first heat exchange unit 3 and then flows into the second radiator 4. Therefore, even if the temperature of a medium to be heated (air or water or the like) flowing into the second radiator 4 is high, the temperature difference between the medium to be heated and the primary-side refrigerant that have flowed into the second radiator 4 can be increased. Thereby, the heat exchange efficiency in the second radiator 4 can be improved. By cooling the primary-side refrigerant that has flowed out of the second radiator 4 in the second heat exchange unit 5, the temperature of the primary-side refrigerant can be decreased (for example, decreased below the temperature of the medium to be heated flowing into the second radiator 4) before it flows into the expansion valve 6. Therefore, the enthalpy difference of the primary-side refrigerant flowing through the evaporator 7 can be increased, and thereby the heat collecting capacity of the evaporator can be improved, and the efficiency (heating capacity) of the heat pumps 100 to 102 can be improved.

Accordingly, a heat pump can be obtained that is capable of operating in a high COP state even if the temperature of the medium to be heated flowing into the first radiator 2 or the second radiator 4 has risen.

As the primary-side refrigerant, a refrigerant (for example, carbon dioxide) that operates in a supercritical state in the course of radiation is used. If a refrigerant that operates at or below critical pressure in the course of radiation is used in a heat pump in which radiators are serially connected, the refrigerant flowing into the radiators may enter a two-phase gas-liquid state. Thus, when distributing the refrigerant in a two-phase gas-liquid state to each path (passage) of the radiators, it is necessary to consider the ratio between the gas phase refrigerant and the liquid phase refrigerant (for example, it is necessary to provide a distributor or the like). However, in Embodiment 1, a refrigerant (for example, carbon dioxide) that operates in a supercritical state (single phase) in the course of radiation is used as the primary-side refrigerant. Thus, it is not necessary to consider the distribution of the refrigerant to each path (passage) of the radiators. Therefore, the flow velocity of the refrigerant flowing through the radiators can be increased, and heat exchange can be efficiently carried out.

Since a refrigerant that operates at or below critical pressure in the course of radiation condenses in the course of radiation, there are cases in which the heat exchangers used in the course of radiation are referred to as condensers. In Embodiment 1 and the subsequent embodiments, the heat exchangers used in the course of radiation are called "radiators" regardless of the type of refrigerant.

Embodiment 2

The heat pump according to the invention can also be constituted as below, for example. Note that in Embodiment 2, items not described in particular are the same as Embodiment 1 and like functions and configurations are described using like reference numerals.

Figure 4:
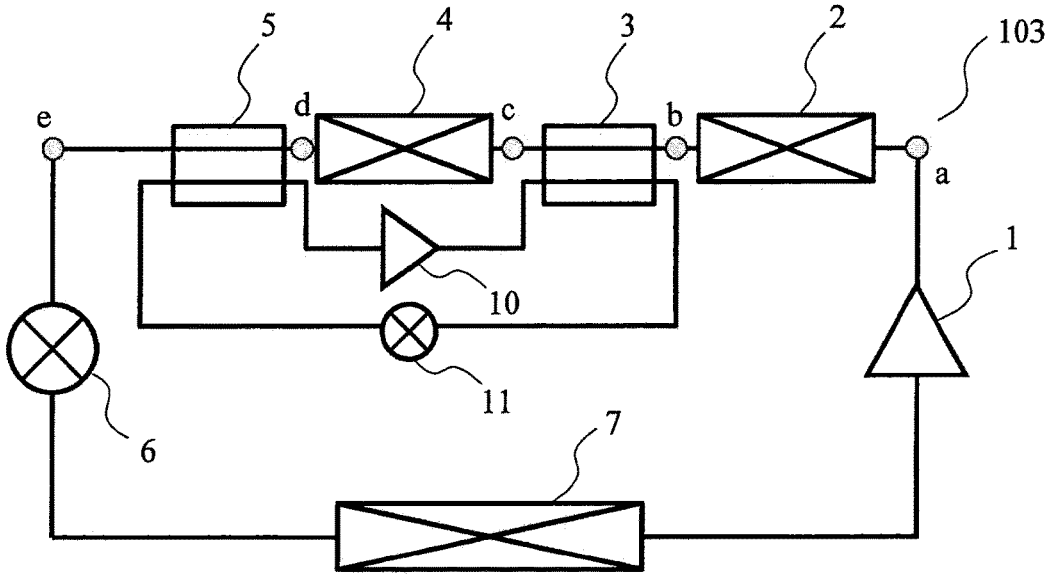
FIG. 4 is a refrigerant circuit diagram showing an example of the heat pump according to Embodiment 2.

FIG. 4 is a refrigerant circuit diagram showing an example of the heat pump according to Embodiment 2.

The primary-side refrigeration cycle of a heat pump 103 according to Embodiment 2 has the same constitution as the primary-side refrigeration cycle of the heat pump 100 of Embodiment 1 as illustrated in FIG. 1. However, the heat pump 103 of Embodiment 2 is different from the heat pump 100 of Embodiment 1 illustrated in FIG. 1 in that it is provided with a secondary-side refrigeration cycle that includes the first heat exchange unit 3 and the second heat exchange unit 5 as constituent elements.

In more detail, the heat pump 103 includes a secondary-side refrigeration cycle in which a second compressor 10, the first heat exchange unit 3, a second expansion valve 11, and the second heat exchange unit 5 are connected in a refrigerant circuit. A secondary-side refrigerant circulates in the secondary-side refrigeration cycle. In other words, the same refrigerant flows in the first heat exchange unit 3 and the second heat exchange unit 5. Further, when viewed from the secondary-side refrigeration cycle, the first heat exchange unit 3 functions as a radiator and the second heat exchange unit 5 functions as an evaporator. In the first heat exchange unit 3 and the second heat exchange unit 5, in order to improve the heat exchange efficiency between the primary-side refrigerant and the secondary-side refrigerant, the flow direction of the primary-side refrigerant and the flow direction of the secondary-side refrigerant counter each other.

In the heat pump 103 according to Embodiment 2, a carbon dioxide refrigerant is used as the primary-side refrigerant. As the secondary-side refrigerant, a propane refrigerant, an HFO-1234yf refrigerant, an ammonia refrigerant, or the like is used. These refrigerants have a higher theoretical COP than that of a carbon dioxide refrigerant at the evaporating temperature of 10 degrees C. to 30 degrees C. and the pseudo-critical temperature or the condensing temperature of 30 degrees C. to 50 degrees C.

That is, the primary-side refrigerant and the secondary-side refrigerant used in the heat pump 103 have a lower GWP than refrigerants such as an R410A refrigerant (whose GWP is approximately 2000) that is normally used in conventional heat pumps. By using this kind of refrigerant, global warming can be suppressed. Note that GWP (global warming potential) is represented by a ratio of the effect each greenhouse gas has on global warming to the effect carbon dioxide has on global warming, and it is a value that has been approved by the Intergovernmental Panel on Climate Change (IPCC) and agreed upon by a panel of signatory nations thereof.

The second expansion valve 11 corresponds to a second pressure reducing device of the invention, and the secondary-side refrigeration cycle corresponds to a second refrigeration cycle of the invention. The secondary-side refrigerant corresponds to a second refrigerant of the invention. The second pressure reducing device is not limited to the second expansion valve 11, and various devices can be used. For example, a capillary or the like can be used as the second pressure reducing device.

Although FIG. 4 describes an example using two radiators (the first radiator 2 and the second radiator 4), any number of radiators can be provided as long as a plurality (two or more) of radiators are serially connected. In this case, a first heat exchange unit 3 may be provided in an upstream piping (refrigerant inlet-side piping) of at least one radiator among the second and subsequent radiators along a direction of flow of the primary-side refrigerant. Further, the second heat exchange unit 5 may be provided in a downstream piping (refrigerant outlet-side piping) of a radiator disposed at the most downstream position along a direction of flow of the primary-side refrigerant.

The plurality of radiators are not limited to an air heat exchanger that exchanges heat with air, and a water heat exchanger can be used. Both air heat exchangers and water heat exchangers may of course be provided in the primary-side refrigeration cycle.

(Description of Operation)

P-h diagrams of the primary-side refrigerant when operating the heat pump 103 constituted as above are described below.

Figure 5:
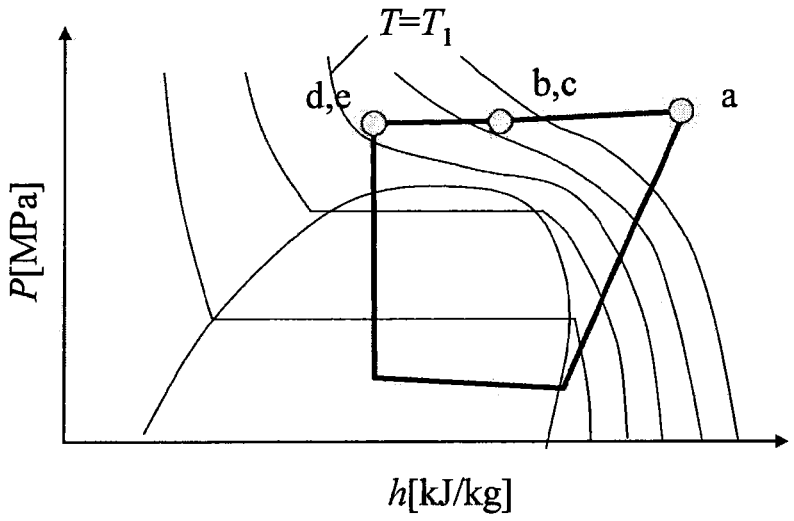
FIG. 5 is a P-h diagram of a primary-side refrigerant when the secondary-side refrigeration cycle is not operated in the heat pump according to Embodiment 2.
Figure 6:
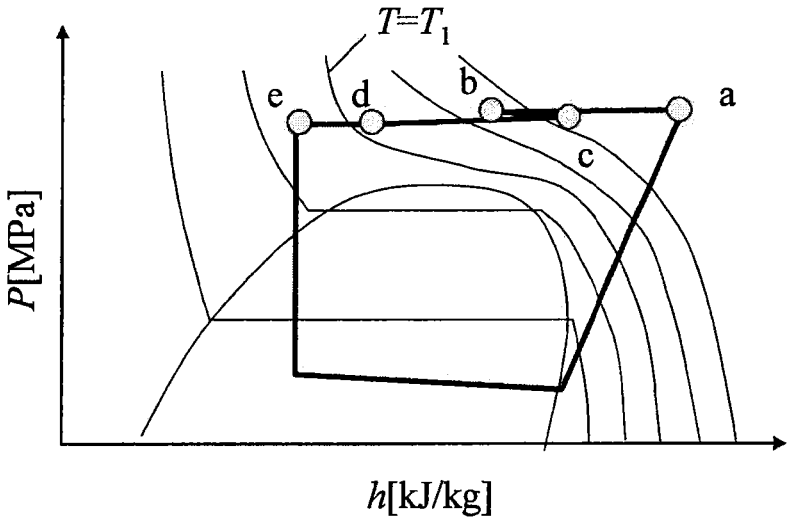
FIG. 6 is a P-h diagram of a primary-side refrigerant when the secondary-side refrigeration cycle is operated in the heat pump according to Embodiment 2.

FIG. 5 is a P-h diagram of a primary-side refrigerant when the secondary-side refrigeration cycle is not operated in the heat pump according to Embodiment 2. FIG. 6 is a P-h diagram of a primary-side refrigerant when the secondary-side refrigeration cycle is operated in the heat pump according to Embodiment 2.

Points a to e shown in FIGS. 5 and 6 show the state of the refrigerant at each position a to e shown in FIG. 4. FIGS. 5 and 6 illustrate a case in which a temperature T of the medium to be heated flowing into the second radiator 4 is T1 [degrees C.].

As shown in FIG. 5, when the secondary-side refrigeration cycle is not operated, the primary-side refrigerant that has flowed out of the first radiator 2 flows into the second radiator 4 without being heated (b→c). Therefore, if the temperature of the medium to be heated flowing into the second radiator 4 is high, the temperature difference between the medium to be heated and the primary-side refrigerant that have flowed into the second radiator 4 becomes small.

In order to heat the medium to be heated in the second radiator 4, the temperature of the primary-side refrigerant at the outlet of the second radiator 4 need to be increased above T1 [ degrees C.] (d). The primary-side refrigerant that has flowed out of the second radiator 4 flows into the expansion valve 6 without being cooled (e). Therefore, if the temperature of the medium to be heated flowing into the second radiator 4 is high, the enthalpy difference of the primary-side refrigerant flowing through the evaporator 7 becomes small, and thus the heating capacity of the heat pump 103 decreases.

On the other hand, as shown in FIG. 6, when the secondary-side refrigeration cycle circuit is operated, the primary-side refrigerant that has flowed out of the first radiator 2 flows into the second radiator 4 after being heated in the first heat exchange unit (b→c). Therefore, even if the temperature of the medium to be heated flowing into the second radiator 4 is high, the temperature difference between the medium to be heated and the primary-side refrigerant that have flowed into the second radiator 4 can be increased. The primary-side refrigerant that has flowed out of the second radiator 4 flows into the expansion valve 6 after being cooled in the second heat exchange unit 5 (d→e). Therefore, the temperature of the primary-side refrigerant flowing into the expansion valve 6 can be decreased below T1 [degrees C.]. Thus, even if the temperature of the medium to be heated flowing into the second radiator 4 is high, the enthalpy difference of the primary-side refrigerant flowing through the evaporator 7 can be increased, and the heating capacity of the heat pump 103 can be improved.

Further, in Embodiment 2, the same refrigerant (the secondary-side refrigerant) flows in the first heat exchange unit 3 and the second heat exchange unit 5. Thus, heat collected from the primary-side refrigerant in the second heat exchange unit 5 can be used for heating of the primary-side refrigerant in the first heat exchange unit 3. Thereby, the heating efficiency of the heat pump 103 can be further improved.

This effect is large when using a refrigerant whose specific heat of liquid is large in a supercritical state, such as a carbon dioxide refrigerant, as the primary-side refrigerant. This kind of primary-side refrigerant has a large specific heat when heated between b→c, and thus the secondary-side refrigeration cycle can be operated in a state of high operating efficiency.

For example, the temperature of the medium to be heated flowing into the radiators (in particular, the second radiator 4) is 35 degrees C., the primary-side refrigerant is carbon dioxide, and the secondary-side refrigerant is a propane refrigerant, and the heat pump 103 is operated so as to decrease the temperature of the primary-side refrigerant at the outlet of the second heat exchange unit 5 to approximately 15 degrees C. to 25 degrees C. If the heat exchangers have been designed such that a log-mean temperature difference during heat exchange of the carbon dioxide refrigerant and the propane refrigerant in each heat exchanger of the first heat exchange unit 3 and the second heat exchange unit 5 is approximately 5 degrees C., COP of the secondary-side refrigerant that heats the carbon dioxide refrigerant becomes about 10 (including loss due to the efficiency of the compressor for propane), and a large heating capacity can be obtained with a small amount of electrical input. The heating capacity over the sum of the electrical inputs of the primary-side refrigeration cycle and the secondary-side refrigeration cycle (system COP) can be increased by 10 to 20% compared to a case in which the secondary-side refrigeration cycle is not operated.

In the heat pump 103 constituted as above, if the temperature of the medium to be heated flowing into the radiators (in particular, the second radiator 4) becomes high, by operating the secondary-side refrigeration cycle, in addition to the effect of Embodiment 1, heat collected from the primary-side refrigerant in the second heat exchange unit 5 can be used for heating of the primary-side refrigerant in the first heat exchange unit 3. Thereby, the heating efficiency of the heat pump 103 can be further improved.

Even if a carbon dioxide refrigerant is used as the primary-side refrigerant and a fluorocarbon refrigerant having a high GWP such as an R410A refrigerant is used as the secondary-side refrigerant, since the secondary-side cycle has a small number of parts and a small capacity, the amount of refrigerant needed for the secondary-side refrigerant is vastly less than the amount of refrigerant needed for the primary-side refrigerant. In other words, the reduction in the amount of fluorocarbon refrigerant used and the highly efficient operation leads to a reduction in the discharge of greenhouse gases. However, by using a refrigerant having a low GWP for both the primary-side refrigerant and the secondary-side refrigerant, the discharge of greenhouse gases associated with refrigerant leakage or the like can be further decreased.

Embodiment 3

For example, the heat pump according to the invention can be used in an air conditioning apparatus like the one described below. Note that in Embodiment 3, items not described in particular are the same as Embodiment 1 or Embodiment 2 and like functions and configurations are described using like reference numerals.

Figure 7:
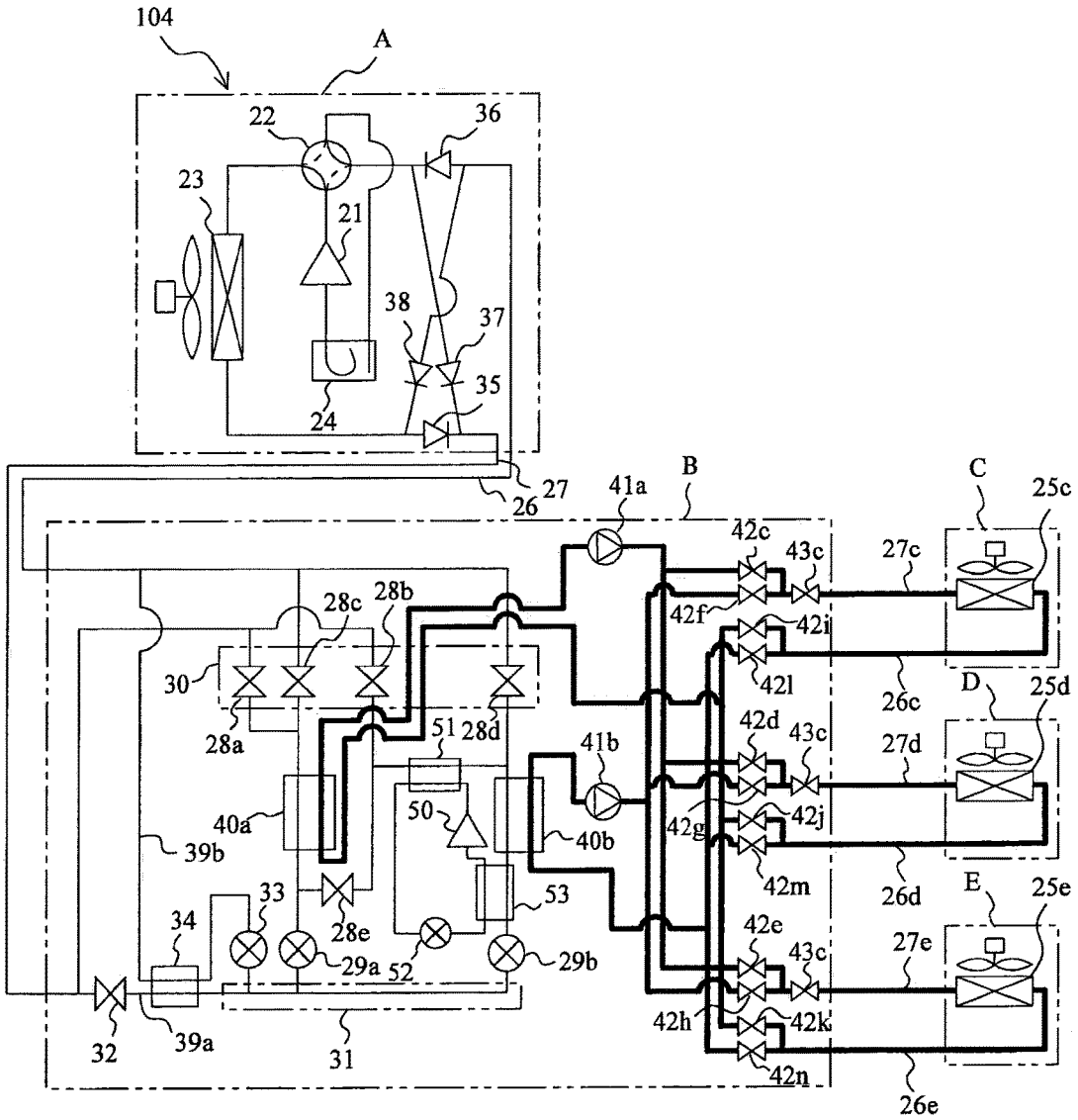
FIG. 7 is a refrigerant circuit diagram showing an example of the heat pump according to Embodiment 3.

FIG. 7 is a refrigerant circuit diagram showing an example of the heat pump according to Embodiment 3.

A heat pump 104 according to Embodiment 3 is a multi-room air conditioning apparatus in which a heat source unit A (outdoor unit), a relay unit B, and a plurality of indoor units (indoor units C, D, and E) are connected by piping and are capable of being placed apart from each other. For example, the heat source unit A can be installed on a roof of a building, the relay unit B can be installed above a ceiling on each floor of the building, and the indoor units C, D, and E can be installed in each room. The heat pump 104 is an air conditioning apparatus capable of setting cooling or heating separately for each indoor unit.

In the heat pump 104, heat transport from the heat source unit A to the relay unit B and heat transport from the relay unit B to the indoor units C, D, and E are carried out using different refrigerant circuits.

Heat transport from the heat source unit A to the relay unit B is carried out by a refrigerant such as carbon dioxide whose pressure upon discharge from a compressor 21 is higher than a critical pressure. Heat transport from the relay unit B to the indoor units C, D, and E is carried out by water. Heat transport from the relay unit B to the indoor units C, D, and E can also be carried out using brine such as antifreeze, a mixture of antifreeze and water, a mixture of water and an additive having a high anticorrosive effect, and the like.

In Embodiment 3, a case in which one relay unit and three indoor units are connected to one heat source unit will be described, but the same description applies when two or more heat source units, two or more relay units, and two or more indoor units are connected.

The constitutions of the heat source unit A, the relay unit B, and the indoor units C, D, and E will be described in detail below.

(Heat Source Unit A)

The heat source unit A includes a compressor 21, a four-way switching valve 22 that switches the flow direction of the refrigerant that has been discharged from the compressor 21, a heat source side heat exchanger 23 (outdoor heat exchanger), an accumulator 24, a flow switching valve constituted by check valves 35 to 38, and the like. The following description will use an air-cooled heat source side heat exchanger as an example of the heat source side heat exchanger 23, but other types of heat exchangers such as a water-cooled heat exchanger can be used as long as it can exchange heat between a refrigerant and another fluid.

In the compressor 21, the four-way switching valve 22 is connected to the discharge side, and the accumulator 24 is connected to the suction side. The four-way switching valve 22 is connected to the compressor 21, the heat source side heat exchanger 23, the accumulator 24, and the flow switching valve. By the four-way switching valve 22, the passage of refrigerant is switched between a passage in which refrigerant that has been discharged from the compressor 21 flows into the heat source side heat exchanger 23 (in other words, a passage in which refrigerant that has flowed out of the flow switching valve flows into the accumulator 24) and a passage in which refrigerant that has been discharged from the compressor 21 flows into the flow switching valve (a passage in which refrigerant that has flowed out of the heat source side heat exchanger 23 flows into the accumulator 24).

The flow switching valve includes four check valves (check valves 35 to 38).

The check valve 35 is provided between the heat source side heat exchanger 23 and a second connecting piping 27, and permits the flow of the refrigerant only from the heat source side heat exchanger 23 to the second connecting piping 27. The check valve 36 is provided between the four-way switching valve 22 of the heat source unit A and a first connecting piping 26, and permits the flow of the refrigerant only from the first connecting piping 26 to the four-way switching valve 22. The check valve 37 is provided between the four-way switching valve 22 of the heat source unit A and the second connecting piping 27, and permits the flow of the refrigerant only from the four-way switching valve 22 to the second connecting piping 27. The check valve 38 is provided between the heat source side heat exchanger 23 and the first connecting piping 26, and permits the flow of the refrigerant only from the first connecting piping 26 to the heat source side heat exchanger 23.

The other end of the second connecting piping 27 is connected to a bypass piping 39*a* of the relay unit B to be described below. The other end of the first connecting piping 26 is connected to a first branching unit 30 of the relay unit B to be described below.

By providing the flow switching valve, refrigerant that has been discharged from the compressor 21 always passes through the second connecting piping 27 and then flows into the relay unit B, and refrigerant flowing out of the relay unit B always passes through the first connecting piping 26. Therefore, the pipe diameter of the second connecting piping 27 can be narrower than the pipe diameter of the first connecting piping 26.

(Indoor Units)

The indoor units C, D, and E each have the same constitution. In more detail, the indoor unit C includes an indoor heat exchanger 25*c*. One end of the indoor heat exchanger 25*c* is connected to flow switching valves 42*i* and 42*l* of the relay unit B to be described below via a first connecting piping 26*c*. The other end of the indoor heat exchanger 25*c* is connected to flow switching valves 42*c* and 42*f* of the relay unit B to be described below via a second connecting piping 27*c*. A flow control device 43*c* is provided in the second connecting piping 27*c* between the indoor heat exchanger 25*c* and the flow switching valves 42*c* and 42*f*. The flow control device 43*c* may also be provided in the first connecting piping 26*c* between the indoor heat exchanger 25*c* and the flow switching valves 42*i* and 42*l*.

The indoor unit D includes an indoor heat exchanger 25*d*. One end of the indoor heat exchanger 25*d* is connected to flow switching valves 42*j* and 42*m* of the relay unit B to be described below via a first connecting piping 26*d*. The other end of the indoor heat exchanger 25*d* is connected to flow switching valves 42*d* and 42*g* of the relay unit B to be described below via a second connecting piping 27*d*. A flow control device 43*c* is provided in the second connecting piping 27*d* between the indoor heat exchanger 25*c* and the flow switching valves 42*d* and 42*g*. The flow control device 43*c* may also be provided in the first connecting piping 26*d* between the indoor heat exchanger 25*d* and the flow switching valves 42*j* and 42*m*.

The indoor unit E includes an indoor heat exchanger 25*e*. One end of the indoor heat exchanger 25*e* is connected to flow switching valves 42*k* and 42*n* of the relay unit B to be described below via a first connecting piping 26*e*. The other end of the indoor heat exchanger 25*e* is connected to flow switching valves 42*e* and 42*h* of the relay unit B to be described below via a second connecting piping 27*e*. A flow control device 43*c* is provided in the second connecting piping 27*e* between the indoor heat exchanger 25*e* and the flow switching valves 42*e* and 42*h*. The flow control device 43*c* may also be provided in the first connecting piping 26*e* between the indoor heat exchanger 25*e* and the flow switching valves 42*k* and 42*n*.

The first connecting pipings 26*c*, 26*d*, and 26*e* are indoor unit-side pipings corresponding to the first connecting piping 26. The second connecting pipings 27*c*, 27*d*, and 27*e* are indoor unit-side pipings corresponding to the second connecting piping 27. The first connecting pipings 26*c*, 26*d*, and 26*e* and the second connecting pipings 27*c*, 27*d*, and 27*e* are pipings through which water flows. The density of the water flowing through the first connecting pipings 26*c*, 26*d*, and 26*e* is approximately the same as the density of the water flowing through the second connecting pipings 27*c*, 27*d*, and 27*e*. Therefore, the pipe diameter of these pipings can be the same.

(Relay Unit B)

The relay unit B has a primary-side refrigeration cycle in which an intermediate heat exchangers 40 (intermediate heat exchangers 40*a* and 40*b*), first flow control devices 29*a* and 29*b*, the first branching unit 30, a second branching unit 31, a second flow control device 32, a third flow control device 33, and the like are connected by piping. The relay unit B also has a secondary-side refrigeration cycle in which a second compressor 50, a first heat exchange unit 51, an expansion valve 52, and a second heat exchange unit 53 are connected by piping.

The first branching unit 30 includes solenoid valves 28*a*, 28*b*, 28*c*, and 28*d*.

One end of each of the solenoid valves 28*a* and 28*c* is connected to the intermediate heat exchanger 40*a*. The other end of the solenoid valve 28*a* is connected to the second connecting piping 27. The other end of the solenoid valve 28*c* is connected to the first connecting piping 26.

One end of each of the solenoid valves 28*b* and 28*d* is connected to the intermediate heat exchanger 40*b*. The first heat exchange unit 51 is provided in a piping connecting the solenoid valve 28*b* and the intermediate heat exchanger 40*b*. The other end of the solenoid valve 28*b* is connected to the second connecting piping 27. The other end of the solenoid valve 28*d* is connected to the first connecting piping 26.

The second branching unit 31 is connected to the intermediate heat exchangers 40*a* and 40*b*. The first flow control device 29*a* is provided between the second branching unit 31 and the intermediate heat exchanger 40*a*. The first flow control device 29*b* and the second heat exchange unit 53 are provided between the second branching unit 31 and the intermediate heat exchanger 40*b* from the second branching unit 31 side. The opening degree of the first flow control device 29*a* is adjusted based on the degree of superheat on the outlet side of the intermediate heat exchanger 40*a* during cooling, and adjusted based on the degree of supercooling of the intermediate heat exchanger 40*a* during heating. The opening degree of the first flow control device 29*b* is adjusted based on the degree of superheat on the outlet side of the intermediate heat exchanger 40*b* during cooling, and adjusted based on the degree of supercooling of the intermediate heat exchanger 40*b* during heating. A solenoid valve 28*e* is provided so that the intermediate heat exchanger 40*b* is connected downstream of the intermediate heat exchanger a during heating operation.

The second branching unit 31 is connected to the second connecting piping 27 via the first bypass piping 39*a*, and connected to the first connecting piping 26 via a second bypass piping 39*b*. The openable and closable second flow control device 32 is provided in the first bypass piping 39*a*, and the third flow control device 33 whose opening degree can be freely adjusted is provided in the second bypass piping 39*b*. An internal heat exchanger 34 that exchanges heat between the refrigerant flowing through the first bypass piping 39*a* and the refrigerant flowing through the second bypass piping 39*b* is provided in the first bypass piping 39*a* and the second bypass piping 39*b*. The internal heat exchanger 34 does not have to be provided.

As described above, the second compressor 50, the first heat exchange unit 51, the expansion valve 52, and the second heat exchange unit 53 are connected by piping to form the secondary-side refrigeration cycle. In the first heat exchange unit 51 and the second heat exchange unit 53, the flow direction of the primary-side refrigerant flowing through the primary-side refrigeration cycle and the flow direction of the secondary-side refrigerant flowing through the secondary-side refrigeration cycle counter each other.

The intermediate heat exchangers 40*a* and 40*b* exchange heat between the primary-side refrigerant and the water that transports heat to the indoor units C, D, and E. The intermediate heat exchangers 40*a* and 40*b* can be, for example, a water plate heat exchanger, a water double pipe heat exchanger, a microchannel water heat exchanger, and the like.

The intermediate heat exchanger 40*a* is provided in the middle of a water circuit in which the water that transports heat to the indoor units C, D, and E circulates. One end of this water circuit is connected to the flow switching valves 42*c*, 42*d*, and 42*e*. The other end of this water circuit is connected to the flow switching valves 42*i*, 42*j*, and 42*k*. A pump 41*a* that circulates the water within the water circuit is provided to this water circuit.

The intermediate heat exchanger 40*b* is provided in the middle of a water circuit in which the water that transports heat to the indoor units C, D, and E circulates. One end of this water circuit is connected to the flow switching valves 42*f*, 42*g*, and 42*h*. The other end of this water circuit is connected to the flow switching valves 42*l*, 42*m*, and 42*n*. A pump 41*b* that circulates the water within the water circuit is provided to this water circuit.

<Description of Operation>

Next, the operation during each operation executed by the heat pump 104 will be described. The operations of the heat pump 104 include the following four modes in accordance with the setting of the cooling operation and the heating operation of the indoor units: a cooling operation, a heating operation, a cooling main operation, and a heating main operation.

In the cooling operation mode, the indoor units are only operable in cooling operation. Therefore, each indoor unit is either in cooling operation or is stopped. In the heating operation mode, the indoor units are only operable in heating operation. Therefore, each indoor unit is either in heating operation or is stopped. The cooling main operation mode is an operation mode in which cooling and heating can be selected in each indoor unit. In the cooling main operation mode, the cooling load is larger than the heating load (the sum of the cooling load and the compressor input is larger than the heating load), and the heat source side heat exchanger 23 is connected to the discharge side of the compressor 21 and functions as a radiator. The heating main operation mode is also an operation mode in which cooling and heating can be selected in each indoor unit. In the heating main operation mode, the heating load is larger than the cooling load (the heating load is larger than the sum of the cooling load and the compressor input), and the heat source side heat exchanger 23 is connected to the suction side of the compressor 21 and functions as an evaporator.

First, in FIGS. 8 to 15, the flow of the refrigerant in each operation mode during normal operation in which the secondary-side refrigeration cycle (the second compressor 50, the first heat exchange unit 51, the expansion valve 52, and the second heat exchange unit 53) is not operated will be described together with P-h diagrams. Therefore, the term "refrigerant" used in the following descriptions of FIGS. 8 to 15 refers to the primary-side refrigerant.

[Cooling Operation Mode]

Figure 8:
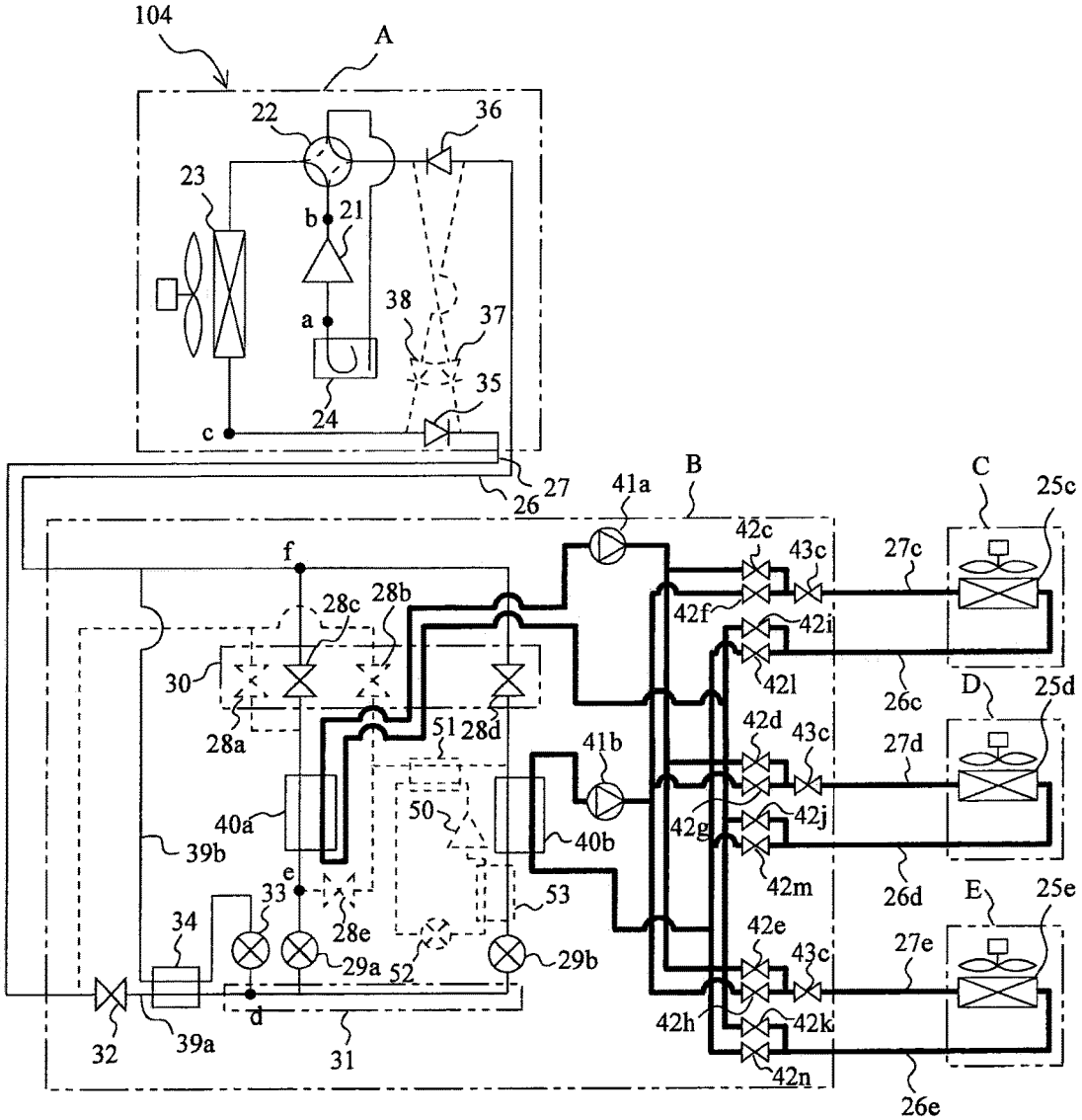
FIG. 8 is a refrigerant circuit diagram showing a flow of a refrigerant and water during cooling operation in the heat pump according to Embodiment 3.
Figure 9:
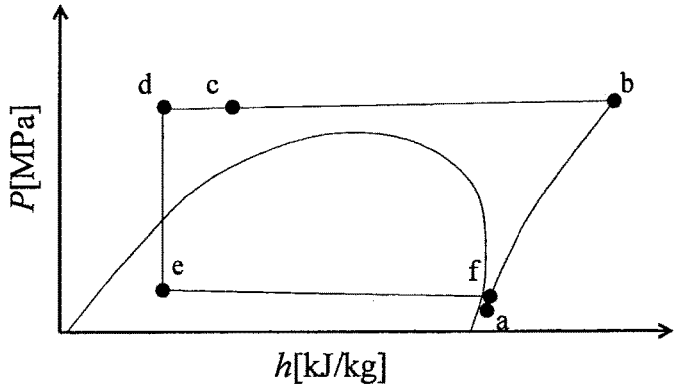
FIG. 9 is a P-h diagram during cooling operation in the heat pump according to Embodiment 3.

FIG. 8 is a refrigerant circuit diagram showing a flow of the refrigerant and water during cooling operation in the heat pump according to Embodiment 3. FIG. 9 is a P-h diagram during cooling operation in the heat pump according to Embodiment 3. The refrigerant states at points a to f shown in FIG. 9 correspond to the refrigerant states at each position a to f shown in FIG. 8.

The following description relates to a case in which all of the indoor units C, D, and E are about to perform a cooling operation. In the cooling operation mode, the four-way switching valve 22 is switched so that refrigerant that has been discharged from the compressor 21 flows into the heat source side heat exchanger 23. The solenoid valves 28*c* and 28*d* are opened, the solenoid valves 28*a* and 28*b* are closed, and the solenoid valve 28*e* is closed. The pipings shown in solid lines are pipings in which refrigerant circulates, and the pipings shown in bold lines are pipings in which water circulates.

The operation of the compressor 21 is started in the above-described state. A low-temperature, low-pressure gas refrigerant is compressed by the compressor 21 and is discharged as a high-temperature, high-pressure gas refrigerant. In the refrigerant compression process in the compressor 21, the refrigerant is compressed so that it is heated more than it is adiabatically compressed on an isentropic line by the amount of adiabatic efficiency of the compressor or the like, and this is represented by the line between point a and point b in FIG. 9. The high-temperature, high-pressure gas refrigerant that has been discharged from the compressor 21 flows into the heat source side heat exchanger 23 through the four-way switching valve 22. At this time, the refrigerant is cooled while heating the outdoor air, and turns into a middle-temperature, high-pressure liquid refrigerant. Taking the pressure loss of the heat source side heat exchanger 23 into account, the refrigerant change in the heat source side heat exchanger 23 is represented by the slightly inclined straight line that is close to horizontal extending from point b to point c in FIG. 9.

The middle-temperature, high-pressure liquid refrigerant that has flowed out of the heat source side heat exchanger 23 passes through the second connecting piping 27, exchanges heat in the internal heat exchanger 34 with refrigerant passing through the second bypass piping 39*b*, and is further cooled to reach point d in FIG. 9. The refrigerant that has flowed out of the internal heat exchanger 34 flows into the second branching unit 31 and branches to flow into the first flow control devices 29*a* and 29*b*. The high-pressure liquid refrigerant is throttled in the first flow control devices 29*a* and 29*b* and is expanded and decompressed, and then enters a low-temperature low-pressure two-phase gas-liquid state. The refrigerant change in the first flow control devices 29*a* and 29*b* is carried out under a constant enthalpy. The refrigerant change at this time is represented by the vertical line extending from point d to point e in FIG. 9.

The low-temperature low-pressure two-phase gas-liquid refrigerant that has left the first flow control devices 29*a* and 29*b* flows into the intermediate heat exchangers 40*a* and 40*b*. The refrigerant is heated while cooling the water to become a low-temperature, low-pressure gas refrigerant. Taking the pressure loss into account, the refrigerant change in the intermediate heat exchangers 40*a* and 40*b* is represented by the slightly inclined straight line that is close to horizontal extending from point e to point f in FIG. 9. The low-temperature, low-pressure gas refrigerant that has left the intermediate heat exchangers 40*a* and 40*b* passes through the solenoid valves 28*c* and 28*d* and flows into the first branching unit 30. The low-temperature, low-pressure gas refrigerant that has merged in the first branching unit 30 passes through the first connecting piping 26 and the four-way switching valve 22 to reach point a in FIG. 9, and then flows into the compressor 21. The low-temperature, low-pressure gas refrigerant that has flowed into the compressor 21 is compressed again in the compressor 21.

In the cooling operation mode, cold water is produced in both of the intermediate heat exchangers 40*a* and 40*b*. Therefore, the passages of the indoor heat exchangers 25*c*, 25*d*, and 25*e* can be connected to either of the intermediate heat exchangers. In other words, the flow switching valves 42*c* to 42*n* can be opened/closed so that the passages of the indoor heat exchangers 25*c*, 25*d*, and 25*e* are connected to either of the intermediate heat exchangers. The water which has been cooled in one of the intermediate heat exchangers 40*a* and 40*b* is made to flow into the indoor heat exchangers 25*c*, 25*d*, and 25*e* by the pumps 41*a* and 41*b* to cool the conditioned space in which the indoor heat exchangers 25*c*, 25*d*, and 25*e* are installed. At this time, by controlling the opening degree of the flow control devices 43*c* in accordance with each indoor cooling load and the like, the flow rate of water flowing into the indoor heat exchangers 25*c*, 25*d*, and 25*e* can be controlled.

[Heating Operation Mode]

Figure 10:
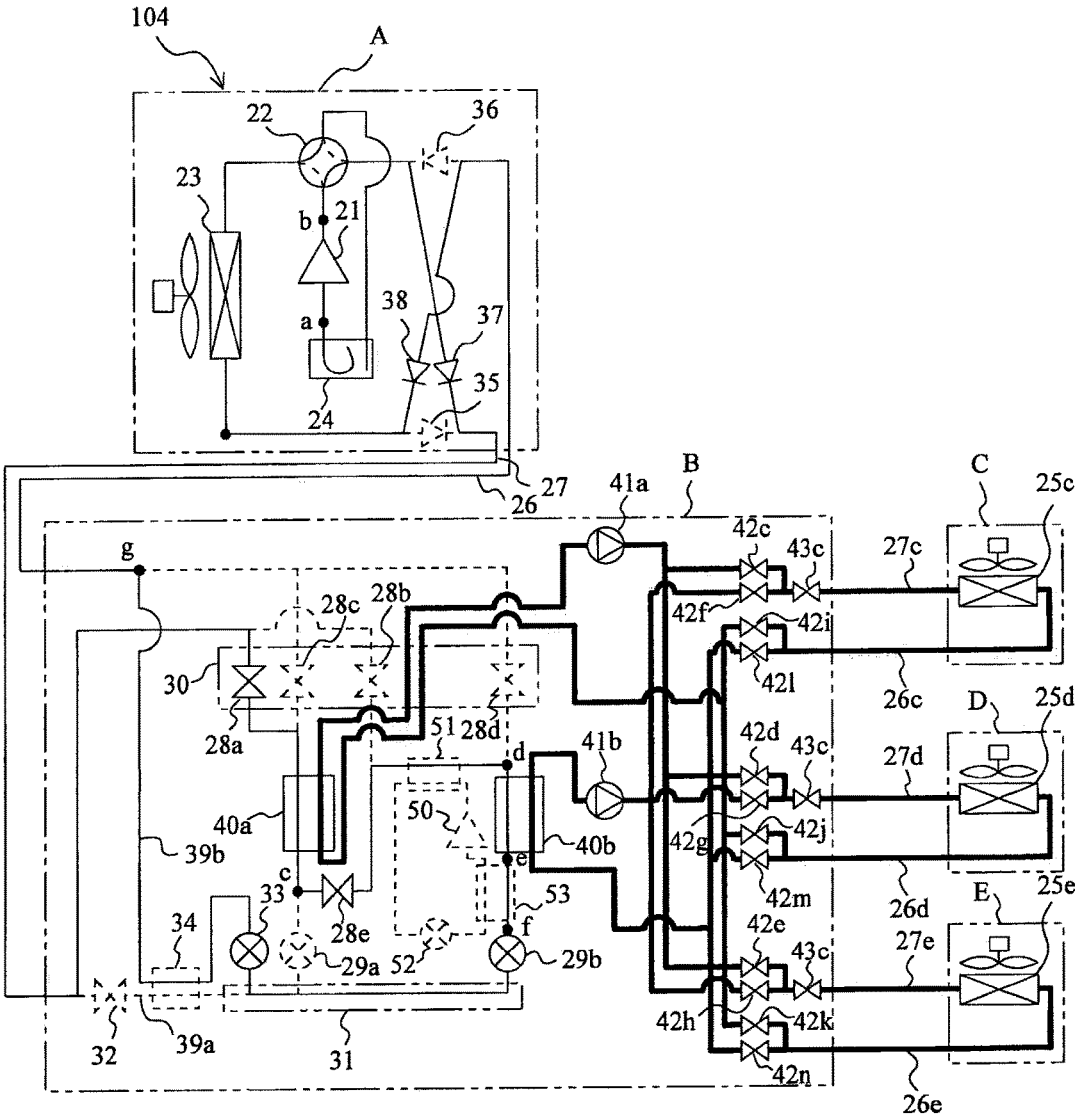
FIG. 10 is a refrigerant circuit diagram showing a flow of the refrigerant and water during heating operation in the heat pump according to Embodiment 3.
Figure 11:
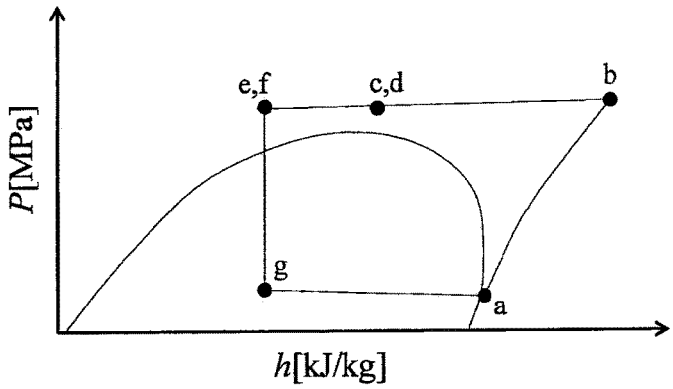
FIG. 11 is a P-h diagram during heating operation in the heat pump according to Embodiment 3.

FIG. 10 is a refrigerant circuit diagram showing a flow of the refrigerant and water during cooling operation in the heat pump according to Embodiment 3. FIG. 11 is P-h diagram during heating operation in the heat pump according to Embodiment 3. The refrigerant states at points a to g shown in FIG. 11 correspond to the refrigerant states at each position a to g shown in FIG. 10.

The following description relates to a case in which all of the indoor units C, D, and E are about to perform a heating operation. In the heating operation mode, the four-way switching valve 22 is switched so that refrigerant that has been discharged from the compressor 21 flows into the first branching unit 30. The solenoid valve 28*a* is opened, the solenoid valves 28*b*, 28*c*, and 28*d* are closed, and the solenoid valve 28*e* is opened, so that the intermediate heat exchanger 40*a* and the intermediate heat exchanger 40*b* are serially connected. The pipings shown in solid lines are pipings in which refrigerant circulates, and the pipings shown in bold lines are pipings in which water circulates.

The operation of the compressor 21 is started in the above-described state. A low-temperature, low-pressure gas refrigerant is compressed by the compressor 21 and is discharged as a high-temperature, high-pressure gas refrigerant. This refrigerant compression process in the compressor is represented by the line between point a and point b in FIG. 11. The high-temperature, high-pressure gas refrigerant that has been discharged from the compressor 21 flows into the intermediate heat exchanger 40*a* via the four-way switching valve 22 and the second connecting piping 27. The refrigerant is cooled while heating the water, and thus becomes a middle-temperature, high-pressure liquid refrigerant. The refrigerant change at this time is represented by the slightly inclined straight line that is close to horizontal extending from point b to point c in FIG. 11.

The middle-temperature, high-pressure liquid refrigerant that has flowed out of the intermediate heat exchanger 40*a* passes through the solenoid valve 28*e* and the first heat exchange unit 51 and then flows into the intermediate heat exchanger 40*b* (point c→point d). The refrigerant is cooled while heating the water, and becomes a middle-temperature, high-pressure liquid refrigerant. The refrigerant change at this time is represented by the slightly inclined straight line that is close to horizontal extending from point d to point e in FIG. 11. The middle-temperature, high-pressure liquid refrigerant that has flowed out of the intermediate heat exchanger 40*b* passes through the second heat exchange unit 53 (point e→point f), and then passes through the first flow control device 29*b* and the third flow control device 33. At this time, the middle-temperature, high-pressure liquid refrigerant is throttled in the first flow control device 29*b* and the third flow control device 33 and is expanded and decompressed, and then enters a low-temperature low-pressure two-phase gas-liquid state. The refrigerant change at this time is represented by the vertical line extending from point f to point g in FIG. 11. Since the refrigerant is a single-phase flow in a supercritical state, there are no problems related to refrigerant distribution at the inlet of the intermediate heat exchanger 40*b* even if the intermediate heat exchangers 40*a* and 40*b* are serially connected. Therefore, the flow velocity of the refrigerant flowing through the intermediate heat exchangers 40*a* and 40*b* can be increased, and heat exchange can be efficiently carried out. Although it would not be an efficient operation because the flow velocity of refrigerant flowing through the intermediate heat exchangers 40*a* and 40*b* would drop, the solenoid valves 28*a* and 28*b* can be opened, the solenoid valves 28*c* to 28*e* can be closed, and the intermediate heat exchangers 40*a* and 40*b* can be connected in parallel so that the flow rate is controlled by the first flow control devices 29*a* and 29*b*.

The low-temperature low-pressure two-phase gas-liquid refrigerant that has left the third flow control device 33 flows into the heat source side heat exchanger 23 via the first connecting piping 26 and is heated while cooling the outdoor air, and thus becomes a low-temperature, low-pressure gas refrigerant. The refrigerant change in the heat source side heat exchanger 23 is represented by the slightly inclined straight line that is close to horizontal extending from point g to point a in FIG. 11. The low-temperature, low-pressure gas refrigerant that has left the heat source side heat exchanger 23 passes through the four-way switching valve 22 and flows into the compressor 21. The low-temperature, low-pressure gas refrigerant that has flowed into the compressor 21 is compressed again in the compressor 21.

In the heating operation mode, hot water is produced in both of the intermediate heat exchangers 40*a* and 40*b*. Therefore, the passages of the indoor heat exchangers 25*c*, 25*d*, and 25*e* can be connected to either of the intermediate heat exchangers. In other words, the flow switching valves 42*c* to 42*n* can be opened/closed so that the passages of the indoor heat exchangers 25*c*, 25*d*, and 25*e* are connected to either of the intermediate heat exchangers. The water which has been heated in one of the intermediate heat exchangers 40*a* and 40*b* is made to flow into the indoor heat exchangers 25*c*, 25*d*, and 25*e* by the pumps 41*a* and 41*b* to heat the conditioned space in which the indoor heat exchangers 25*c*, 25*d*, and 25*e* are installed. At this time, by controlling the opening degree of the flow control devices 43*c* in accordance with each indoor cooling load and the like, the flow rate of water flowing into the indoor heat exchangers 25*c*, 25*d*, and 25*e* can be controlled.

[Cooling Main Operation Mode]

Figure 12:
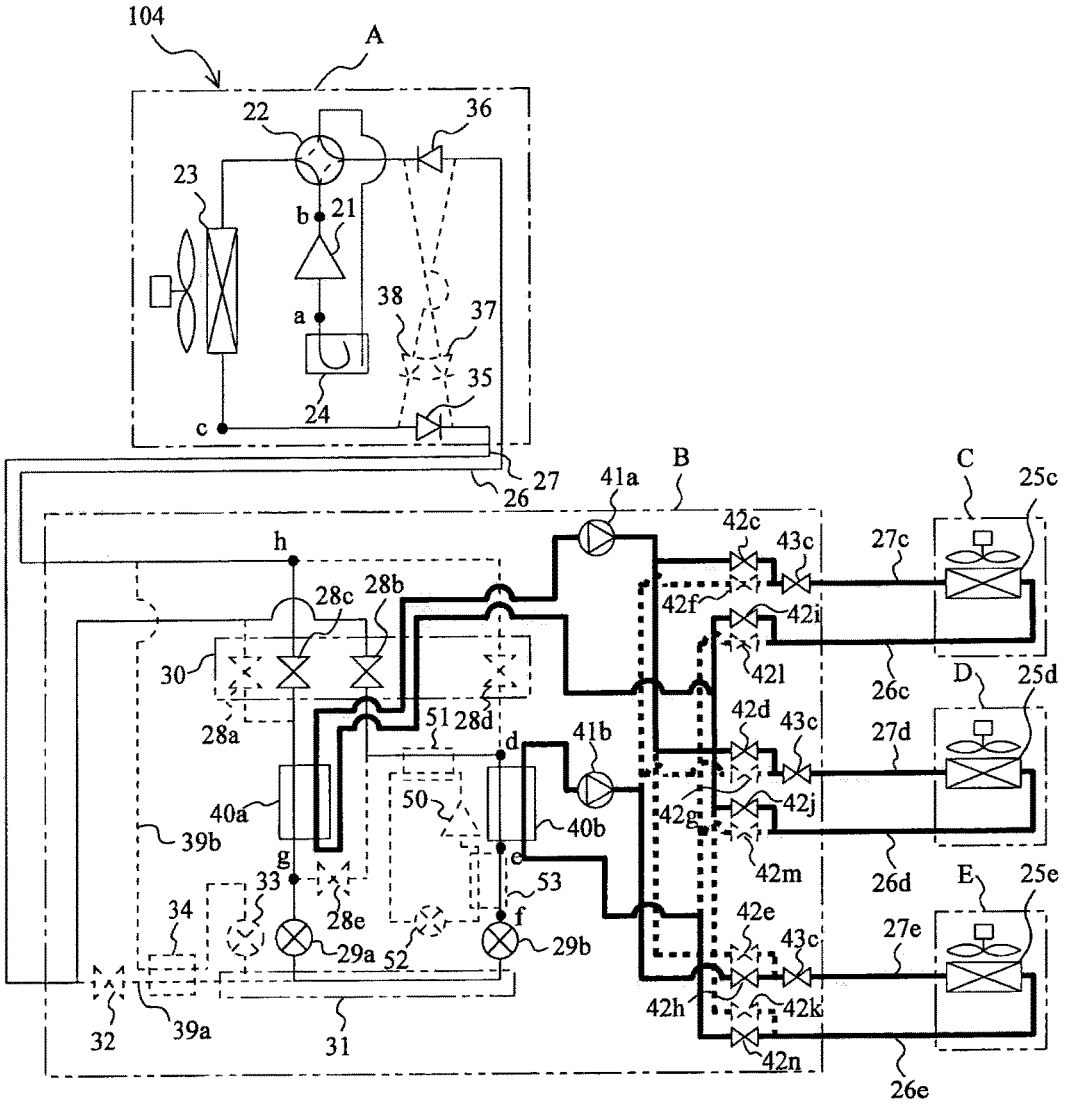
FIG. 12 is a refrigerant circuit diagram showing a flow of the refrigerant and water during cooling main operation in the heat pump according to Embodiment 3.
Figure 13:
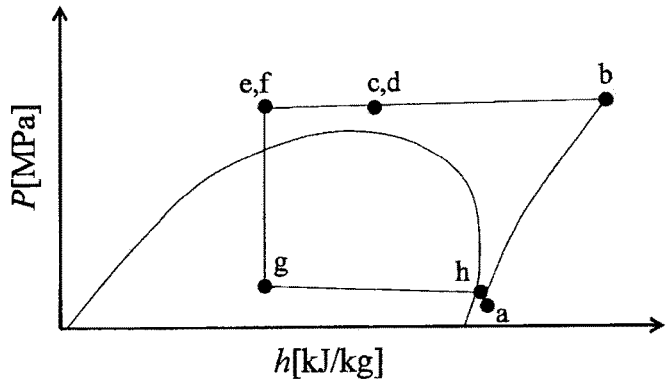
FIG. 13 is a P-h diagram during cooling main operation in the heat pump according to Embodiment 3.

FIG. 12 is a refrigerant circuit diagram showing a flow of the refrigerant and water during cooling main operation in the heat pump according to Embodiment 3. FIG. 13 is P-h diagram during cooling main operation in the heat pump according to Embodiment 3. The refrigerant states at points a to h shown in FIG. 13 correspond to the refrigerant states at each position a to h shown in FIG. 12.

The following description relates to a case in which the indoor units C and D are cooling and the indoor unit E is heating. In the cooling main operation mode, the four-way switching valve 22 is switched so that refrigerant that has been discharged from the compressor 21 flows into the heat source side heat exchanger 23. The solenoid valves 28*b* and 28*c* are opened, the solenoid valves 28*a* and 28*d* are closed, and the solenoid valve 28*e* is closed. In the cooling main operation mode, the intermediate heat exchanger 40*a* produces cold water, and the intermediate heat exchanger 40*b* produces hot water. The heat source side heat exchanger 23 and the intermediate heat exchanger 40*b* that produces hot water are serially connected as radiators. The pipings shown in solid lines are pipings in which refrigerant circulates, and the pipings shown in bold lines are pipings in which water circulates.

The operation of the compressor 21 is started in the above-described state. A low-temperature, low-pressure gas refrigerant is compressed by the compressor 21 and is discharged as a high-temperature, high-pressure gas refrigerant. This refrigerant compression process in the compressor is represented by the line between point a and point b in FIG. 13. The high-temperature, high-pressure gas refrigerant that has been discharged from the compressor 21 flows into the heat source side heat exchanger 23 through the four-way switching valve 22. At this time, the refrigerant that has flowed into the heat source side heat exchanger 23 is cooled while heating the outdoor air, leaving an amount of heat necessary for heating, and is turned into a middle-temperature, high-pressure refrigerant. The refrigerant change in the outdoor heat exchanger 23 is represented by the slightly inclined straight line that is close to horizontal extending from point b to point c in FIG. 13.

The middle-temperature, high-pressure refrigerant that has flowed out of the heat source side heat exchanger 23 passes through the second connecting piping 27 and the first heat exchange unit 51, and flows into the intermediate heat exchanger 40*b* that produces hot water. The refrigerant undergoes hardly any change at this time, and reaches the state shown by point d in FIG. 13. The middle-temperature, high-pressure refrigerant that has flowed into the intermediate heat exchanger 40*b* is cooled while heating the hot water in the intermediate heat exchanger 40*b*, and thus becomes a middle-temperature, high-pressure liquid refrigerant. The refrigerant change in the intermediate heat exchanger 40*b* is represented by the slightly inclined straight line that is close to horizontal extending from point d to point e in FIG. 13.

The refrigerant that has flowed out of the intermediate heat exchanger 40*b* that produces hot water passes through the second heat exchange unit 53 (point e→point f), and then passes through the first flow control devices 29*b* and 29*a*. When passing through the first flow control devices 29*b* and 29*a*, the middle-temperature, high-pressure liquid refrigerant is throttled in the first flow control devices 29*b* and 29*a* and is expanded and decompressed, and then enters a low-temperature low-pressure two-phase gas-liquid state. The refrigerant change in the first flow control devices 29*b* and 29*a* is carried out under a constant enthalpy. The refrigerant change at this time is represented by the vertical line extending from point f to point g in FIG. 13.

The low-temperature low-pressure two-phase gas-liquid refrigerant that has left the first flow control devices 29*a* and 29*b* flows into the intermediate heat exchanger 40*a* that produces cold water. The low-temperature, low-pressure two-phase gas-liquid refrigerant that has flowed into the intermediate heat exchanger 40*a* that produces cold water is heated while cooling the water to become a low-temperature, low-pressure gas refrigerant. The refrigerant change in the intermediate heat exchanger 40*a* is represented by the slightly inclined straight line that is close to horizontal extending from point g to point h in FIG. 13. The low-temperature, low-pressure gas refrigerant that has left the intermediate heat exchanger 40*a* flows into the first branching unit 30 (more specifically, the solenoid valve 28*c*). The low-temperature, low-pressure gas refrigerant that has flowed into the first branching unit 30 passes through the first connecting piping 26 and the four-way switching valve 22 to reach point a in FIG. 13, and then flows into the compressor 21. The low-temperature, low-pressure gas refrigerant that has flowed into the compressor 21 is compressed again in the compressor 21.

In the cooling main operation mode, the flow switching valves 42*c* and 42*n* are opened/closed to form a passage in which the intermediate heat exchanger 40*b* that produces hot water and the indoor unit E that performs heating are connected, and a passage in which the intermediate heat exchanger 40*a* that produces cold water and the indoor units C and D that perform cooling are connected.

In other words, the hot water made to flow into the indoor heat exchanger 25*e* by the pump 41*b* heats the conditioned space in which the indoor unit E is installed. At this time, by controlling the opening degree of the flow control device 43*c* in accordance with the indoor heating load and the like where the indoor unit E is installed, the flow rate of water flowing into the indoor heat exchanger 25*e* can be controlled. Further, the cold water made to flow into the indoor heat exchangers 25*c* and 25*d* by the pump 41*a* cools the conditioned spaces in which the indoor units C and D are installed. At this time, by controlling the opening degree of the flow control devices 43*c* in accordance with the indoor cooling load and the like where the indoor units C and D are installed, the flow rate of water flowing into the indoor heat exchangers 25*c* and 25*d* can be controlled.

[Heating Main Operation Mode]

Figure 14:
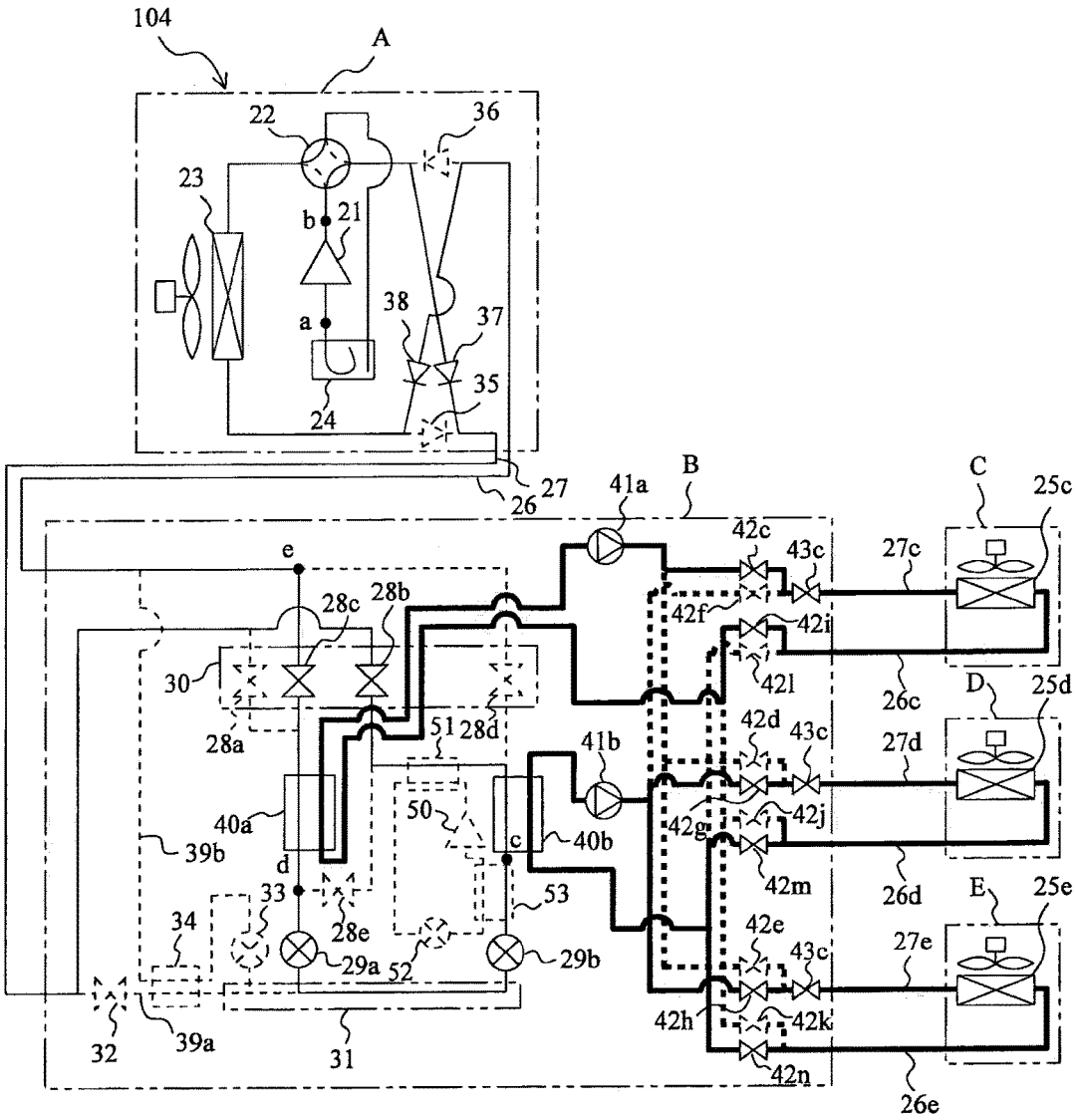
FIG. 14 is a refrigerant circuit diagram showing a flow of the refrigerant and water during heating main operation in the heat pump according to Embodiment 3.
Figure 15:
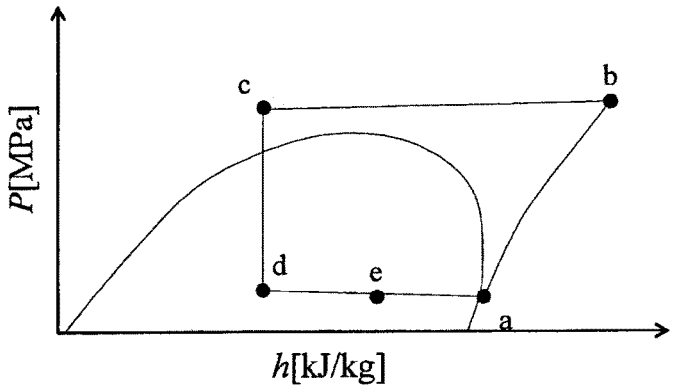
FIG. 15 is a P-h diagram during heating main operation in the heat pump according to Embodiment 3.

FIG. 14 is a refrigerant circuit diagram showing a flow of the refrigerant and water during heating main operation in the heat pump according to Embodiment 3. FIG. 15 is a P-h diagram during heating main operation in the heat pump according to Embodiment 3. The refrigerant states at points a to e shown in FIG. 15 correspond to the refrigerant states at each position a to e shown in FIG. 14.

The following description relates to a case in which the indoor unit C is cooling and the indoor units D and E are heating. In the heating main operation mode, the four-way switching valve 22 is switched so that refrigerant that has been discharged from the compressor 21 flows into the first branching unit 30. The solenoid valves 28*b* and 28*c* are opened, the solenoid valves 28*a* and 28*d* are closed, and the solenoid valve 28*e* is closed. In the heating main operation mode, the intermediate heat exchanger 40*a* produces cold water, and the intermediate heat exchanger 40*b* produces hot water. The pipings shown in solid lines are pipings in which refrigerant circulates, and the pipings shown in bold lines are pipings in which water circulates.

The operation of the compressor 21 is started in the above-described state. A low-temperature, low-pressure gas refrigerant is compressed by the compressor 21 and is discharged as a high-temperature, high-pressure gas refrigerant. This refrigerant compression process in the compressor is represented by the line between point a and point b in FIG. 15. The high-temperature, high-pressure gas refrigerant that has been discharged from the compressor 21 flows into the intermediate heat exchanger 40*b* that produces hot water via the four-way switching valve 22 and the second connecting piping 27. The high-temperature, high-pressure gas refrigerant that has flowed into the intermediate heat exchanger 40*b* is cooled while heating the water, and thus becomes a middle-temperature, high-pressure liquid refrigerant. The refrigerant change in the intermediate heat exchanger 40*b* is represented by the slightly inclined straight line that is close to horizontal extending from point b to point c in FIG. 15.

The middle-temperature, high-pressure liquid refrigerant that has flowed out of the intermediate heat exchanger 40*b* passes through the first flow control devices 29*b* and 29*a*. When passing through the first flow control devices 29*b* and 29*a*, the middle-temperature, high-pressure liquid refrigerant is throttled in the first flow control devices 29*b* and 29*a* and is expanded and decompressed, and then enters a low-temperature low-pressure two-phase gas-liquid state. The refrigerant change at this time is represented by the vertical line extending from point c to point d in FIG. 15. The low-temperature low-pressure two-phase gas-liquid refrigerant that has left the first flow control device 29*a* flows into the intermediate heat exchanger 40*a* that produces cold water. The low-temperature low-pressure two-phase gas-liquid refrigerant that has flowed into the intermediate heat exchanger 40*a* is heated while cooling the cold water to become a low-temperature, low-pressure two-phase gas-liquid refrigerant. The refrigerant change at this time is represented by the slightly inclined straight line that is close to horizontal extending from point d to point e in FIG. 15.

The low-temperature low-pressure two-phase gas-liquid refrigerant that has left the intermediate heat exchanger 40*a* passes through the first connecting piping 26 and flows into the heat source side heat exchanger 23. The low-temperature low-pressure two-phase gas-liquid refrigerant that has flowed into the heat source side heat exchanger 23 receives heat from the outdoor air and becomes a low-temperature, low-pressure gas refrigerant. The refrigerant change at this time is represented by the slightly inclined straight line that is close to horizontal extending from point e to point a in FIG. 15. The low-temperature, low-pressure gas refrigerant that has left the heat source side heat exchanger 23 passes through the four-way switching valve 22 and flows into the compressor 21. The low-temperature, low-pressure gas refrigerant that has flowed into the compressor 21 is compressed again in the compressor 21.

In the cooling main operation mode, the flow switching valves 42*c* and 42*n* are opened/closed to form a passage in which the intermediate heat exchanger 40*b* that produces hot water and the indoor units D and E that perform heating are connected, and a passage in which the intermediate heat exchanger 40*a* that produces cold water and the indoor unit C that performs cooling are connected.

In other words, the hot water that flows into the indoor heat exchangers 25*d* and 25*e* by the pump 41*b* heats the conditioned spaces in which the indoor units D and E are installed. At this time, by controlling the opening degree of the flow control devices 43*c* in accordance with the indoor heating load or the like where the indoor units D and E are installed, the flow rate of water flowing into the indoor heat exchangers 25*d* and 25*e* can be controlled. Further, the cold water made to flow into the indoor heat exchangers 25*c* and 25*d* by the pump 41*a* cools the conditioned spaces in which the indoor units C and D are installed. At this time, by controlling the opening degree of the flow control device 43*c* in accordance with the indoor cooling load and the like where the indoor unit C is installed, the flow rate of water flowing into the indoor heat exchanger 25*c* can be controlled.

Next, cases in which the secondary-side refrigeration cycle (the second compressor 50, the first heat exchange unit 51, the expansion valve 52, and the second heat exchange unit 53) is operated in the heating operation mode and the cooling main operation mode will be described.

[Heating Operation Mode]

Figure 16:
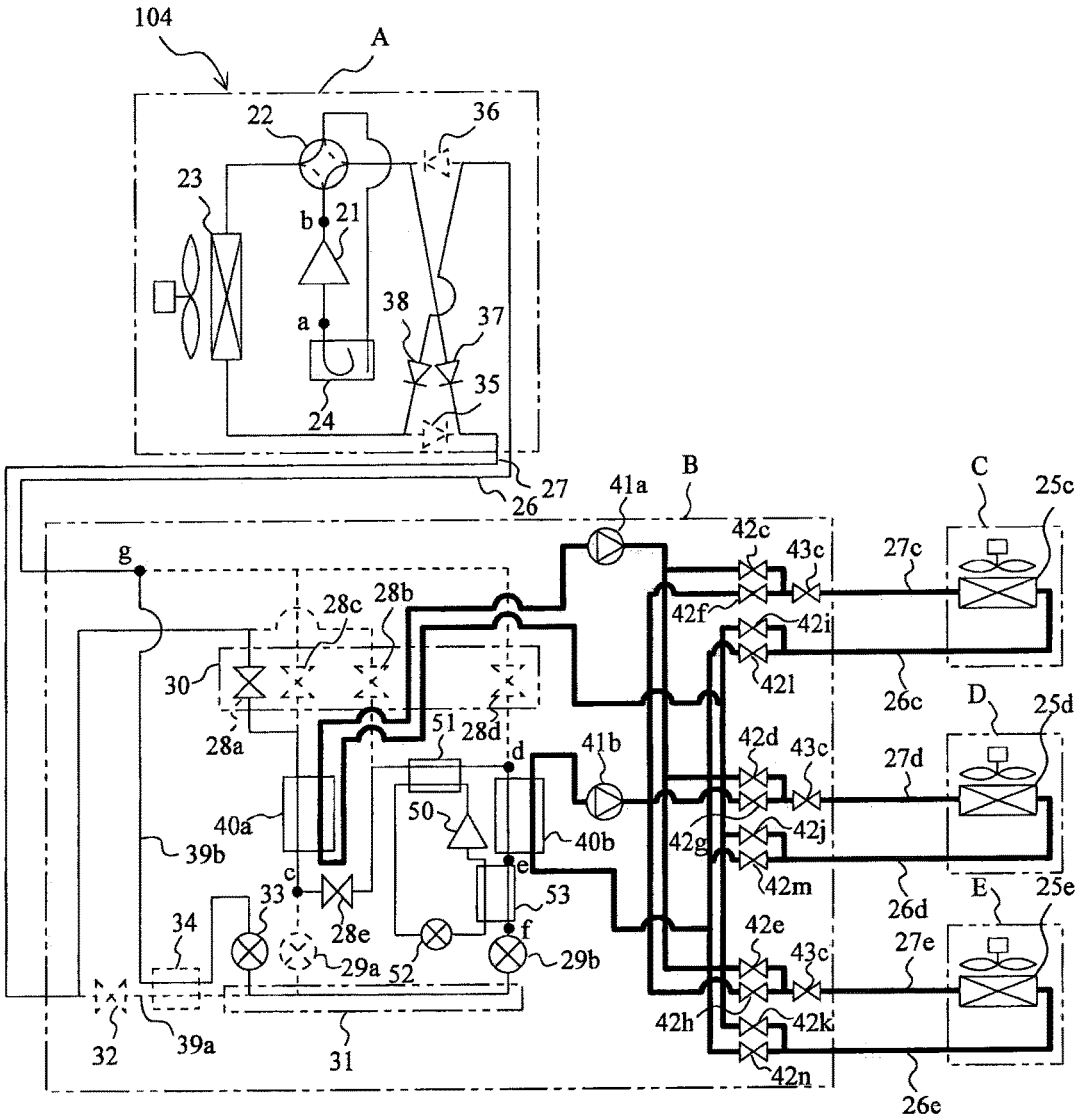
FIG. 16 is a diagram showing a flow of the refrigerant and water when the secondary-side cycle is operated in the heating operation mode of the heat pump according to Embodiment 3.
Figure 17:
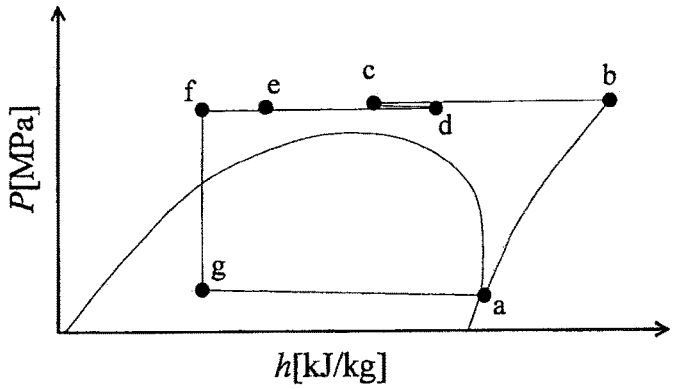
FIG. 17 is a P-h diagram when the secondary-side cycle is operated in the heating operation mode of the heat pump according to Embodiment 3.

FIG. 16 is a diagram showing a flow of the refrigerant and water when the secondary-side cycle is operated in the heating operation mode of the heat pump according to Embodiment 3. Further, FIG. 17 is a P-h diagram when the secondary-side cycle is operated in the heating operation mode of the heat pump according to Embodiment 3. The refrigerant states at points a to g shown in FIG. 17 correspond to the refrigerant states at each position a to g shown in FIG. 16. In FIG. 16, the pipings shown in solid lines are pipings in which refrigerant circulates, and the pipings shown in bold lines are pipings in which water circulates.

The flow of the primary-side refrigerant and the water shown in FIG. 16 is the same as the flow of the primary-side refrigerant and the water shown in FIG. 10, except that in FIG. 16 the secondary-side refrigerant also circulates in the secondary-side refrigeration cycle.

By operating the secondary-side refrigeration cycle, the primary-side refrigerant that has left the intermediate heat exchanger 40*a* (point c) is heated by the secondary-side refrigerant in the first heat exchange unit 51 (point d). Therefore, the temperature of the primary-side refrigerant that flows into the intermediate heat exchanger 40*b* rises, and the heat exchange performance in the intermediate heat exchanger 40*b* improves. The primary-side refrigerant that has left the intermediate heat exchanger 40*b* (point e) is cooled by the secondary-side refrigerant in the second heat exchange unit 53 (point f). Therefore, the heating operation can be carried out efficiently.

[Cooling Main Operation Mode]

Figure 18:
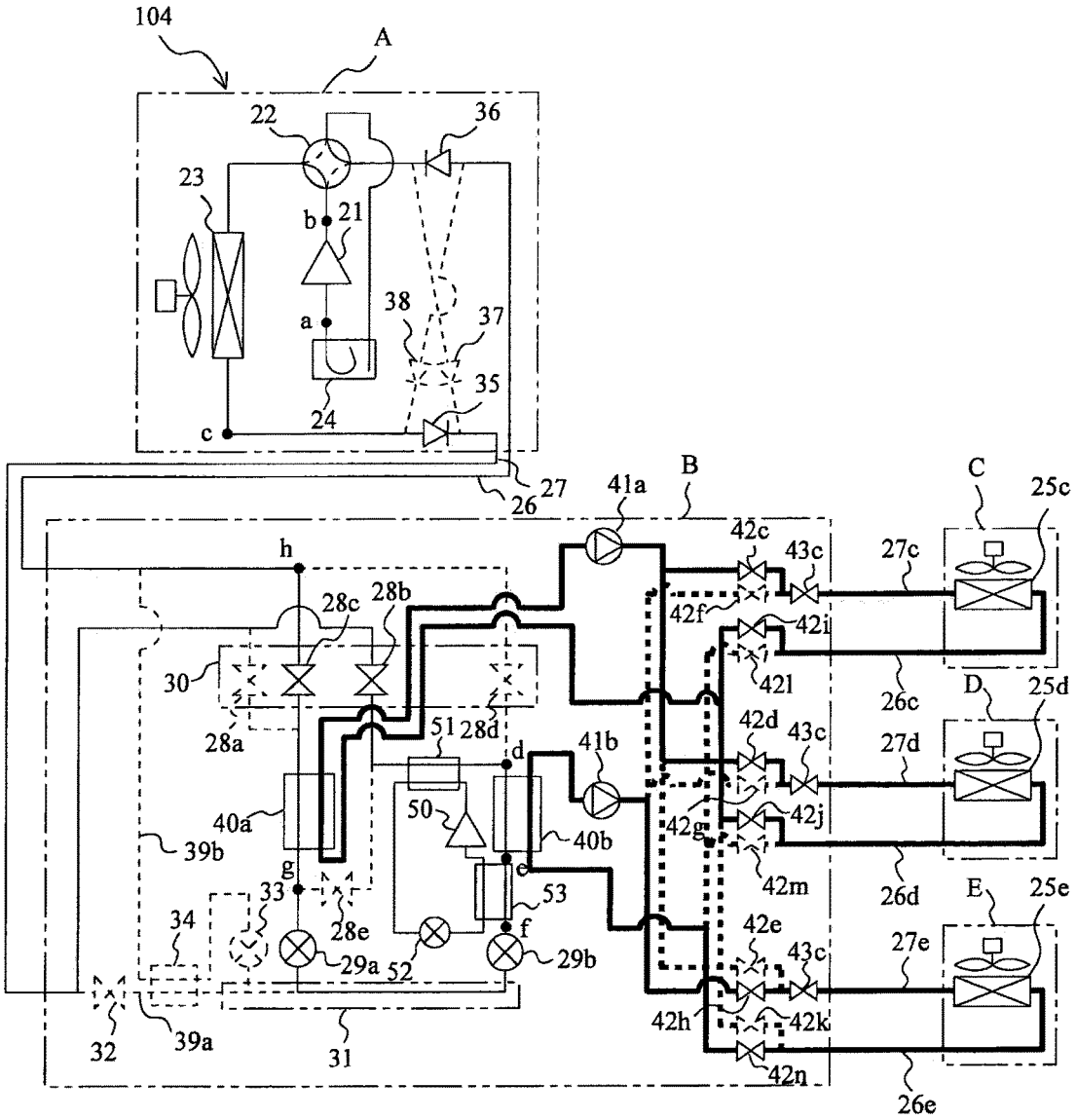
FIG. 18 is a diagram showing a flow of the refrigerant and water when the secondary-side cycle is operated in the cooling main operation mode of the heat pump according to Embodiment 3.
Figure 19:
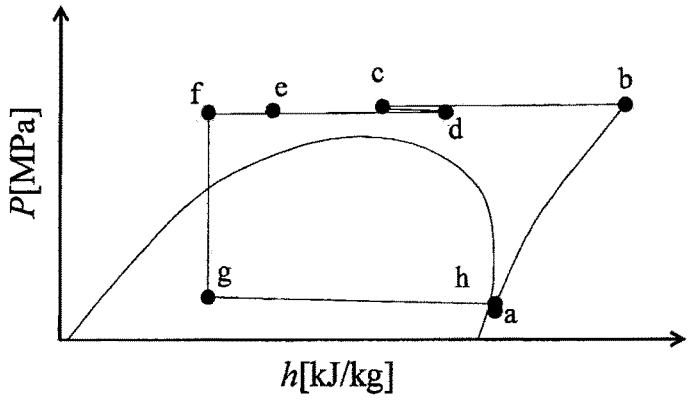
FIG. 19 is a P-h diagram when the secondary-side cycle is operated in the cooling main operation mode of the heat pump according to Embodiment 3.

FIG. 18 is a diagram showing a flow of the refrigerant and water when the secondary-side cycle is operated in the cooling main operation mode of the heat pump according to Embodiment 3. FIG. 19 is a P-h diagram when the secondary-side cycle is operated in the cooling main operation mode of the heat pump according to Embodiment 3. The refrigerant states at points a to h shown in FIG. 19 correspond to the refrigerant states at each position a to f shown in FIG. 18. In FIG. 18, the pipings shown in solid lines are pipings in which refrigerant circulates, and the pipings shown in bold lines are pipings in which water circulates.

The flow of the primary-side refrigerant and the water shown in FIG. 12 is the same as the flow of the primary-side refrigerant and the water shown in FIG. 18, except that in FIG. 18 the secondary-side refrigerant also circulates in the secondary-side refrigeration cycle.

By operating the secondary-side refrigeration cycle, the primary-side refrigerant that has left the intermediate heat exchanger 40*a* (point c) is heated by the secondary-side refrigerant in the first heat exchange unit 51 (point d). Therefore, the temperature of the primary-side refrigerant that flows into the intermediate heat exchanger 40*b* rises, and the heat exchange performance in the intermediate heat exchanger 40*b* improves. The primary-side refrigerant that has left the intermediate heat exchanger 40*b* (point e) is cooled by the secondary-side refrigerant in the second heat exchange unit 53 (point f). Therefore, the amount cooled from point e→point f can be used to heat the hot water, and the cooling main operation can be carried out efficiently.

Figure 20:
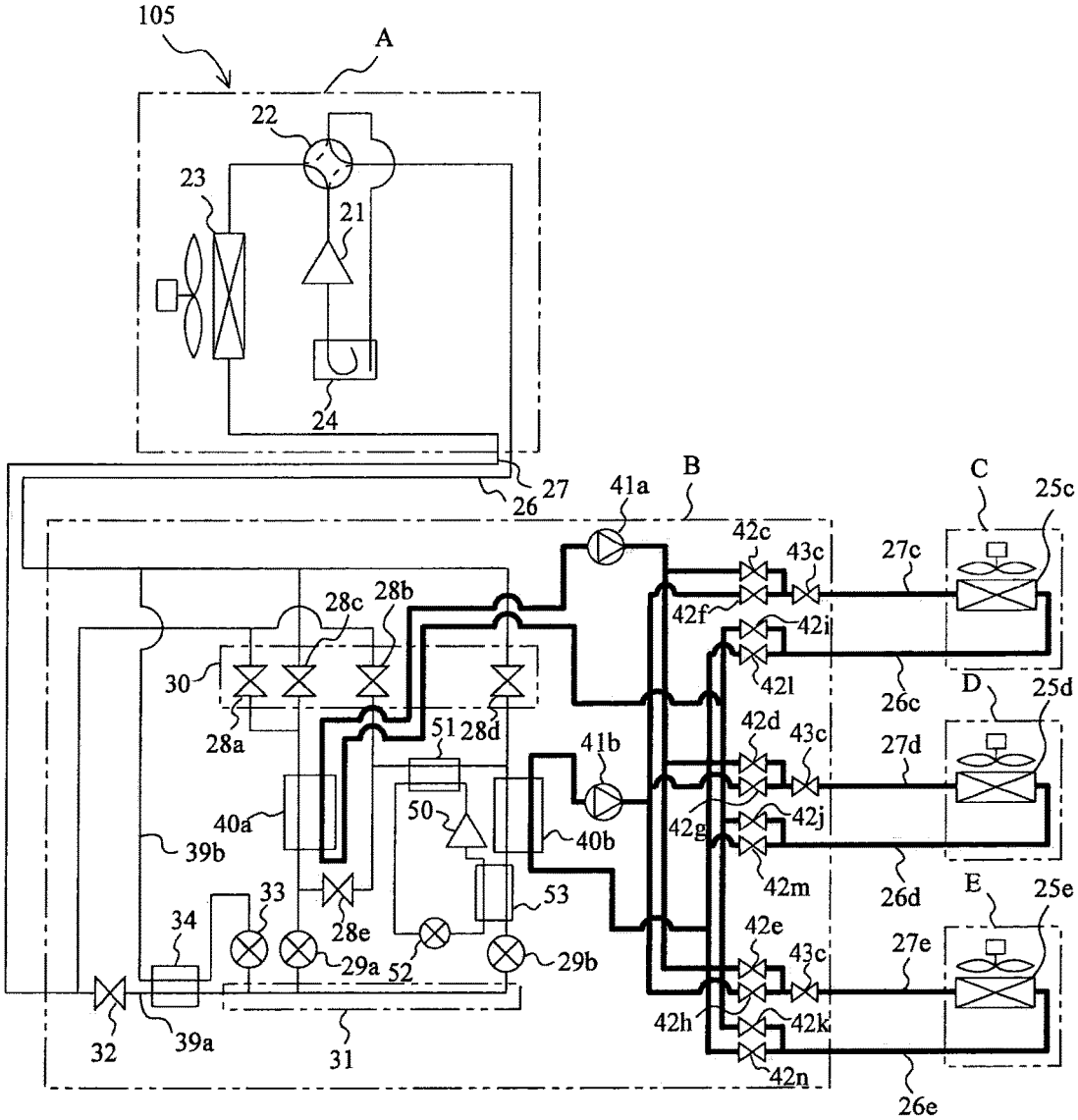
FIG. 20 is a refrigerant circuit diagram showing another example of the heat pump according to Embodiment 3.

FIG. 20 is a refrigerant circuit diagram showing another example of the heat pump according to Embodiment 3.

A heat pump 105 according to Embodiment 3 differs from the heat pump 104 in that the check valves 35 to 38 are not provided as flow switching valves. In this circuit, in the heating operation mode and the heating main operation mode, the direction of refrigerant flowing through the first connecting piping 26 and the direction of refrigerant flowing through the second connecting piping 27 are opposite to those in the heat pump 104. In the heating operation mode and the heating main operation mode, the opening and closing of the solenoid valves 28*a* to 28*d* are also opposite to those in heat pump 104. In this refrigerant circuit, in the heating operation mode and the cooling main operation mode, by operating the secondary-side refrigeration cycle as described above, COP can be greatly improved.

Figure 21:
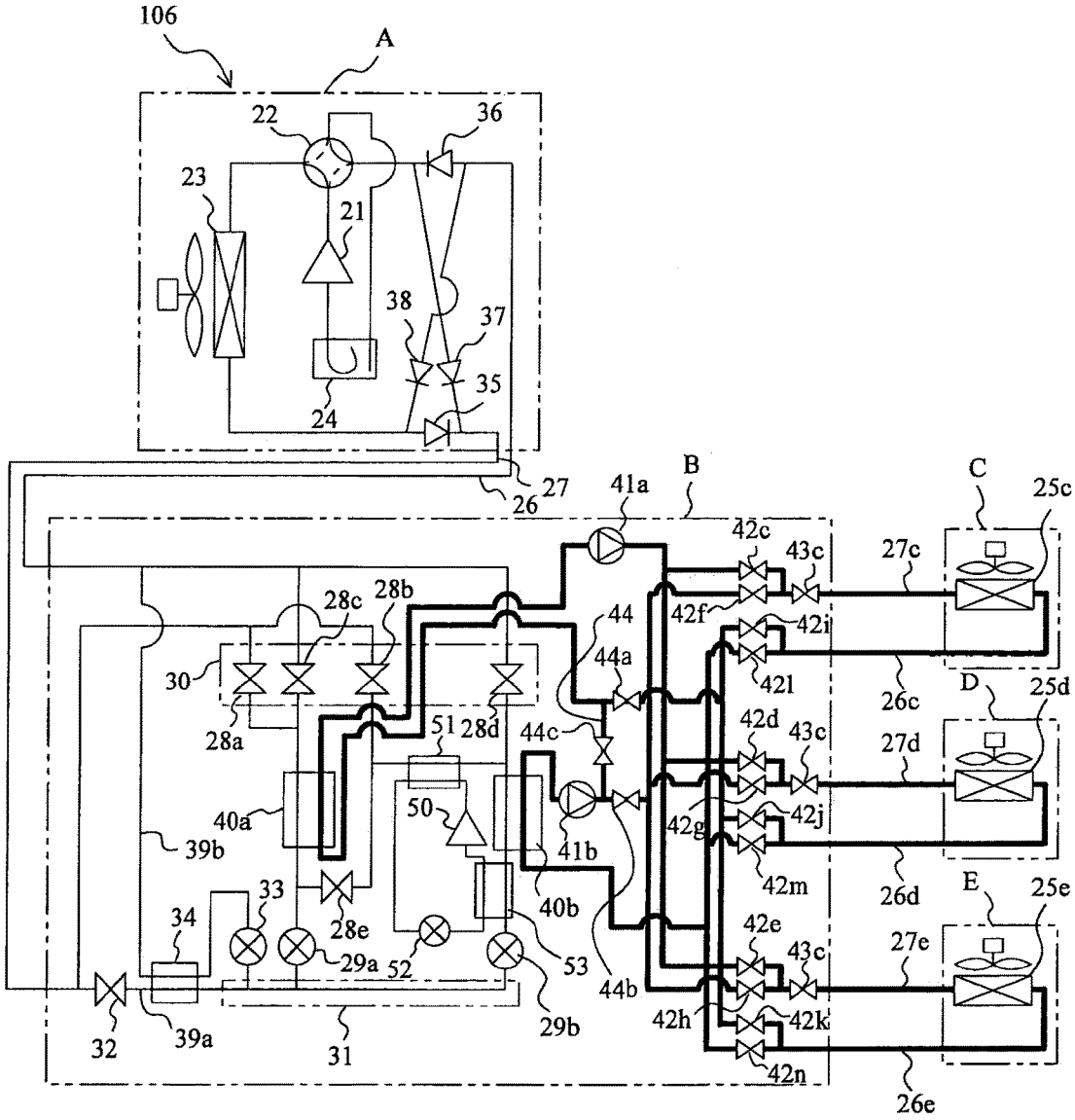
FIG. 21 is a refrigerant circuit diagram showing a further example of the heat pump according to Embodiment 3.

FIG. 21 is a refrigerant circuit diagram showing a further example of the heat pump according to Embodiment 3.

In a heat pump 106 according to Embodiment 3, a water piping 44 that connects the water piping downstream of the pump 41*b* and the water piping upstream of the intermediate heat exchanger 40*a* is provided. A flow switching valve 44*c* is provided to the water piping 44. Also, a flow switching valve 44*b* is provided to the water piping downstream of the pump 41*b* at a location further downstream than the connection part with the water piping 44. Further, a flow switching valve 44*a* is provided to the water piping upstream of the intermediate heat exchanger 40*a* at a location further upstream than the connection part with the water piping 44. In all other constitutions, the heat pump 106 is the same as the heat pump 104.

In this circuit, by closing the flow switching valves 44*a* and 44*b* and opening the flow switching valve 44*c*, the intermediate heat exchangers 40*a* and 40*b* can be serially connected also in the water-side circuit. By opening the flow switching valves 44*a* and 44*b* and closing the flow switching valve 44*c*, the intermediate heat exchangers 40*a* and 40*b* can be connected in parallel. In the heating operation mode, the intermediate heat exchangers 40*a* and 40*b* are serially connected, and in the other operation modes, the intermediate heat exchangers 40*a* and 40*b* are connected in parallel. At this time, during heating operation, the intermediate heat exchangers 40*a* and 40*b* are serially connected, and thus the flow velocity of the water can be increased and heat exchange can be carried out efficiently. In this circuit also, in the heating operation mode and the cooling main operation mode, by operating the secondary-side refrigeration cycle as described above, COP can be greatly improved.

Figure 22:
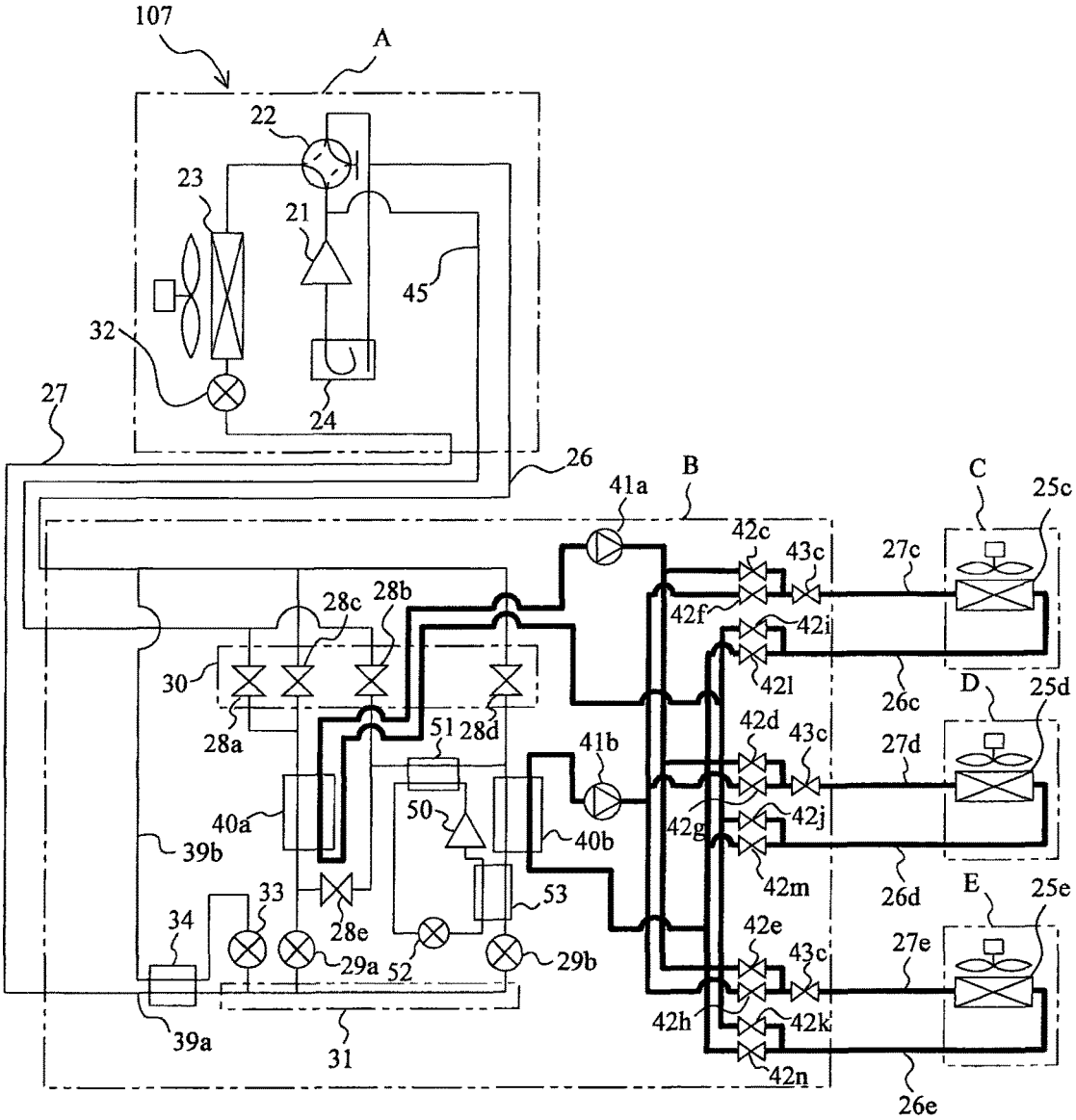
FIG. 22 is a refrigerant circuit diagram showing a still further example of the heat pump according to Embodiment 3.

FIG. 22 is a refrigerant circuit diagram showing a further example of the heat pump according to Embodiment 3.

A heat pump 107 according to Embodiment 3 differs from the heat pump 105 in that a third connecting piping 45 that connects the discharge piping of the compressor 1 with the solenoid valves 28*a* and 28*b* is provided so that refrigerant that has been discharged from the compressor 1 flows directly into the intermediate heat exchangers 40*a* and 40*b*. As long as the second flow control device 32 is provided to the second connecting piping 27, it may be in the heat source unit A or in the relay unit B.

In the heat pumps 104 to 106, the intermediate heat exchanger performing heating in the cooling main operation mode and the heat source side heat exchanger 23 were serially connected, and the intermediate heat exchanger performing cooling in the heating main operation mode and the heat source-unit side heat exchanger 23 were serially connected. On the other hand, in the heat pump 107, the intermediate heat exchanger performing heating in the cooling main operation mode and the heat source side heat exchanger 23 are connected in parallel, and the intermediate heat exchanger performing cooling in the heating main operation mode and the heat source side heat exchanger 23 are connected in parallel. In this circuit also, in the heating operation mode, by operating the secondary-side refrigeration cycle as described above, COP can be greatly improved.

The heat pumps 105 to 107 may also be configured as circuits in which the internal heat exchanger 34 and the second bypass piping 39*b* are not provided. In the heat pump 107, the water-side circuit may be configured as a circuit in which the intermediate heat exchangers 40*a* and 40*b* are serially connected. The four-way switching valve 22 in the heat pumps 104 to 107 is not limited thereto, and the circuit switching function can be alternatively achieved by installing a plurality of opening/closing valves (solenoid valves) or three-way valves.

In the heat pumps 104 to 107 constituted as above, in the operation modes in which the radiators are serially connected (the heating operation mode and the cooling main operation mode), by operating the secondary-side refrigeration cycle, COP can be greatly improved.

Further, in the heat pumps 104 to 107 constituted as above, heat transport to the indoor units C, D, and E is carried out by water. Thus, even if leakage of the primary-side refrigerant or secondary-side refrigerant occurs, the primary-side refrigerant and secondary-side refrigerant can be prevented from penetrating into the indoors. Hence, a safe heat pump can be obtained.

When heat transport from the relay unit B to the indoor units C, D, and E is carried out by a refrigerant, the flow control devices are normally installed near the indoor units C, D, and E. On the other hand, when heat transport from the relay unit B to the indoor units C, D, and E is carried out by water, it is possible to install the flow control devices 43*c* in the relay unit B because temperature of water flowing in the water piping is not changed by pressure loss. In other words, with control of the temperature difference of water flowing in and water flowing out by controlling the opening degree of the flow control devices 43*c* installed in the relay unit B, the conditioned space can be air conditioned. Since the flow control devices 43*c* are separated away from the conditioned space, noise to the conditioned space such as driving of the control valves or flowing noise of the refrigerant when passing through the valves can be reduced.

When the flow control devices 43*c* are installed in the relay unit B, control of the flow control devices 43*c* connected to the indoor heat exchangers 25*c*, 25*d*, and 25*e* can be collectively carried out in the relay unit B. Control in the indoor units C, D, and E can be limited to only control of the fan based on information such as the setting status of an indoor unit remote control, thermo off, and whether the heat source unit A is defrosting.

In addition, by carrying out heat transport from the heat source unit A to the relay unit B with the primary-side refrigerant, the pumps 41*a* and 41*b* used for driving water can be reduced in size, and the power for transporting water can be reduced, thus achieving energy saving.

REFERENCE SIGNS LIST

1 compressor; 2 first radiator (air heat exchanger, water heat exchanger); 3 first heat exchange unit (heating unit); 4 second radiator (air heat exchanger, water heat exchanger); 5 second heat exchange unit (cooling unit); 6 expansion valve; 7 evaporator; 8, 9 pump; 10 second compressor; 11 second expansion valve; 21 compressor; 22 four-way switching valve (flow switching valve); 23 heat source side heat exchanger (outdoor heat exchanger); 24 accumulator; 25*c*, 25*d*, 25*e* indoor heat exchanger; 26 first connecting piping; 27 second connecting piping; 28 solenoid valve; 29*a*, 29*b* first flow control device; 30 first branching unit; 31 second branching unit; 32 second flow control device; 33 third flow control device; 34 internal heat exchanger; 35 to 38 check valve (flow switching valve); 39*a* first bypass piping; 39*b* second bypass piping; 40, 40*a*, 40*b* intermediate heat exchanger; 41*a*, 41*b* pump; 42 flow switching valve; 43*c* flow control device; 44 water piping; 44*a*, 44*b*, 44*c* flow switching valve; 45 third connecting piping; 50 second compressor; 51 first heat exchange unit (heating unit); 52 expansion valve; 53 second heat exchange unit (cooling unit); 100 to 107 heat pump; A heat source unit (outdoor unit); B relay unit; C, D, E indoor unit.

The invention claimed is:

1. A heat pump, comprising:

a first compressor, a first radiator, a second radiator, a first pressure reducing device, and an evaporator being connected by first refrigerant piping to form a first refrigeration cycle, the elements of the first refrigeration cycle being arranged such that a first refrigerant circulates in a direction of flow from the first compressor, then through the first radiator, then through the second radiator, then through the first pressure reducing device, and then through the evaporator; and a second compressor, a first heat exchange unit, a second pressure reducing device and a second heat exchange unit being connected by second refrigerant piping to form a second refrigeration cycle, the elements of the second refrigeration cycle being arranged such that a second refrigerant different from the first refrigerant circulates in a direction of flow from the second compressor, then through the first heat exchange unit, then through the second pressure reducing device and then through the second heat exchange unit, wherein in the first refrigeration cycle, the first refrigerant operates in a supercritical state, the first compressor generates maximum pressure in the first refrigeration cycle to make the first refrigerant the supercritical state, the first refrigerant in the supercritical state radiates heat at the first radiator and the second radiator, and the first pressure reducing device decompresses the first refrigerant radiated heat at the first radiator and the second radiator to change the first refrigerant from the supercritical state to a two-phase gas-liquid state, wherein in the second refrigeration cycle, the first heat exchange unit exchanges heat between the second refrigerant and the first refrigerant flowing out from the first radiator and flowing into the second radiator, and the second heat exchange unit exchanges heat between the second refrigerant and the first refrigerant flowing out from the second radiator and flowing into the first pressure reducing device, wherein heat collected from the first refrigerant at the second heat exchange unit is used for heating the first refrigerant at the first heat exchange unit, and wherein a temperature of the first refrigerant flowing into the second radiator is higher than a temperature of the first refrigerant flowing out from the first radiator.

2. The heat pump of claim 1, wherein a temperature of the first refrigerant flowing into the first pressure reducing device is controlled to be lower than a temperature of a medium to be heated flowing into the first radiator and the second radiator.

3. The heat pump of claim 1, wherein in the first heat exchange unit and the second heat exchange unit, a flow direction of the first refrigerant and a flow direction of the second refrigerant counter each other.

4. The heat pump of claim 1, wherein the second refrigerant has a theoretical COP at an evaporating temperature of 10 degrees C. to 30 degrees C. and a psuedo-critical temperature or condensing temperature of 30 degrees C. to 50 degrees C. that is higher than a theoretical COP of the first refrigerant at an evaporating temperature of 10 degrees C. to 30 degrees C. and a psuedo-critical temperature or condensing temperature of 30 degrees C. to 50 degrees C.

5. The heat pump of claim 1, wherein the first refrigerant includes a carbon dioxide.

6. The heat pump of claim 1, wherein the second refrigerant has a lower global warming potential than a R410A refrigerant.

7. The heat pump of claim 1, wherein the heat pump is used for a multi-room air conditioning apparatus in which a heat source unit, a relay unit, and a plurality of indoor units are connected by piping to be placed apart from each other, wherein heat transport from the heat source unit to the relay unit is carried out by the first refrigerant and heat transport from the relay unit to the plurality of indoor units is carried out by a refrigerant different from the first refrigerant, and wherein the second refrigeration cycle is disposed in the relay unit.

* * * * *